US008801484B2

(12) United States Patent
Oshio

(10) Patent No.: US 8,801,484 B2
(45) Date of Patent: Aug. 12, 2014

(54) LIFE PRESERVER

(75) Inventor: Kozo Oshio, Kanagawa (JP)

(73) Assignee: Kozo Oshio, Kanagawa (JP)

( * ) Notice: Subject to any disclaimer, the term of this patent is extended or adjusted under 35 U.S.C. 154(b) by 0 days.

(21) Appl. No.: 13/401,849

(22) Filed: Feb. 22, 2012

(65) Prior Publication Data

US 2012/0149260 A1 Jun. 14, 2012

Related U.S. Application Data

(63) Continuation of application No. PCT/JP2010/064657, filed on Aug. 23, 2010.

(30) Foreign Application Priority Data

Aug. 26, 2009 (JP) ..... 2009-195584
Oct. 21, 2009 (JP) ..... 2009-242644
Mar. 1, 2010 (JP) ..... 2010-044293

(51) Int. Cl.
*B63C 9/125* (2006.01)

(52) U.S. Cl.
USPC ..... 441/108; 441/98

(58) Field of Classification Search
USPC ..... 441/88–102
See application file for complete search history.

(56) References Cited

U.S. PATENT DOCUMENTS 3,584 A * 5/1844 De Liancourt ..... 441/90
205,617 A * 7/1878 d'Alessandro ..... 441/88

FOREIGN PATENT DOCUMENTS

| | | | |
|---|---|---|---|
| JP | S35-17626 | Y | 7/1960 |
| JP | S35-22525 | Y | 9/1960 |
| JP | S45-13562 | Y | 6/1970 |
| JP | S62-82900 | U | 5/1987 |
| JP | 93299/1988 | U | 6/1988 |
| JP | S63-85493 | U | 6/1988 |
| JP | H1-70814 | U | 5/1989 |
| JP | H3-8094 | U | 1/1991 |
| JP | 1175/1992 | U | 1/1992 |
| JP | H07-223587 | A | 8/1995 |
| JP | H8-104291 | A | 4/1996 |
| JP | H10-329789 | A | 12/1998 |
| JP | 2000-318683 | A | 11/2000 |
| JP | 2003-200887 | A | 7/2003 |
| JP | 2005-502542 | A | 1/2005 |

OTHER PUBLICATIONS

International Preliminary Report on Patentability for International Application No. PCT/JP2010/064657 mailed on Mar. 29, 2012.
English translation of International Search Report for International application No. PCT/JP2010/064657; date of mailing: Nov. 30, 2010.

* cited by examiner

*Primary Examiner* — Edwin Swinehart

(57) ABSTRACT

The present invention utilizes the resilient force (i.e. the force to deform when pressure is added and to return to the original shape when the pressure is removed) of an elastic member or bias member. A large pressure if added in advance to the elastic member or bias member disposed in a preserver body to set the preserver body in a thin and flat state. In an emergency, the resilient force of the elastic member or bias member causes water or air to be sucked into the preserver body. The volume of the preserver body is expanded by the air sucked in due to the resilient force of the elastic member or bias member or by gas generated by a chemical reaction between the sucked-in water and a foaming agent. The increased volume causes the preserver body to float, thereby enabling a wearer to breathe.

6 Claims, 55 Drawing Sheets

MAN FALLEN FROM TANKER SURVIVES BY CLINGING TO PLASTIC BOTTLE 1009.8.14 12:51

TOPIC OF THIS NEWS: FLIGHT, MARITIME ACCIDENT, MOUNTAIN ACCIDENT

Around 7:45 a.m. on the 13th, a Japanese man (24) who had fallen into the ocean approximately 25 kilometers east of Yoronjima in Kagoshima prefecture was rescued by a Liberian freight vessel. The man had used a plastic bottle as a flotation device while drifting for approximately 2 hours. The 10th maritime safety department (Kagoshima) stated that " if he hadn't grabbed the plastic bottle, he might not have survived. "

According to this department, the man was a crewman on a tanker bound for Okinawa, and fell off the vessel into the ocean due to heaving of the boat while processing waste on the aft deck. The man was not wearing a life preserver, but managed to grab on to a 2-litre plastic bottle that fell overboard with him.

ARTICLE, 2009.8.14

*FIG. 13A*

■Little Progress in Life Preserver Usage

The fishing industry includes a large number of older workers, with 35% to 37% of those involved in the fishing industry being over 65 years old, as of 2005, and therefore it is very important for workers to wear life preservers to compensate for their decreased strength. However, in 2006, only 31% of people involved in maritime accidents on fishing vessels were wearing a life jacket. This is only 60% the rate of life preserver usage on recreational boats, which is 52%, and across the country more than 2 of every 3 people do not wear life preservers.

The 2nd maritime safety department and others plan to increase efforts to realize 100% life preserver usage, before the rule making it mandatory to wear life preservers on single-person fishing boats goes into effect in April 2008.

ARTICLE, 2009.8. 4

*FIG. 13B*

LIFE PRESERVER

CROSS REFERENCE TO RELATED APPLICATION

The contents of the following Japanese patent applications and International patent application are incorporated herein by reference:

Japanese Patent Application NO. 2009-195584 filed on Aug. 26, 2009,

Japanese Patent Application NO. 2009-242644 filed on Oct. 21, 2009,

Japanese Patent Application NO. 2010-044293 filed on Mar. 1, 2010, and

International Patent Application NO. PCT/JP2010/064657 filed on Aug. 23, 2010.

BACKGROUND

1. Technical Field

The present invention relates to a life preserver worn in the ocean, a lake, a river, or a pool, for example.

2. Related Art

Many people drown every summer. What begins as simple swimming or playing in the water can potentially turn into a drowning danger through carelessness. There are many types of cases that result in drowning incidents, but such cases can be broadly separated into two types.

One type is when someone who cannot swim at all ends up in water too deep to stand in and drowns. The other type is when someone who is capable of swimming is overexerted and lacks the energy to continue swimming. Although a bit of a digression, the inventor of the present invention had an experience of nearly drowning due to exhaustion. There is a famous saying that "a drowning man will grasp even a leaf," and if a drowning man can achieve even a little buoyancy, he can continue breathing and survive. This point is illustrated by the article in FIG. 13A, which describes an actual case of a man being saved by a plastic bottle.

Life jackets and buoyancy bags are conventional examples of life preservers that provide a body with buoyancy. If these life preservers are attached to the body, the head can be kept above water even when the arms and legs cannot move, and even in cases such as those above that can lead to drowning, the drowning victim can be kept breathing until help arrives. In this way, life jackets and buoyancy bags can be likened to seat belts used in automobiles or safety nets used for workers at high locations. Therefore, many incidents of drowning can be avoided and lives can be saved by wearing these two types of life preservers.

When a life jacket and a buoyancy bag are worn, the body can be kept sufficiently above water and the risk of drowning can be eliminated, but the fact is that these life preservers are not often worn in reality. FIG. 13B shows an article relating to this point. The reasons for this are thought to be as follows.

For buoyancy bags:

1) Buoyancy bags are worn by children, and so many adults are too embarrassed to wear buoyancy bags.

2) Buoyancy bags can provide sufficient buoyancy, but sometimes the buoyancy can be so great as to prevent a person from swimming. Even if a person can swim, it is difficult to perform the proper strokes when buoyancy bags are interfering with both arms.

For life jackets:

1) Adults are not usually embarrassed to wear a life jacket, but a life jacket is generally not something that is worn when someone goes swimming.

2) If a life jacket is worn when swimming, the jacket rises up from the body in the same manner as the buoyancy bags, thereby interfering with the swimming.

Even with these problems, it is wise for people who cannot swim or are not strong swimmers to always wear a life preserver on the off chance of there being a water-related accident. However, in reality, there are many instances where people do not wear a life jacket for work or leisure activities, due to the above reasons.

Conventional life jackets are usually thin and flat, and are designed such that air is sent into the life jacket by a compressed gas bottle in an emergency or such that air is generated by a chemical reaction and then sent into the jacket. Both of these designs are expensive and the components or mechanisms for filling the life jacket with air are bulky, and therefore few people end up wearing such life jackets. Japanese Patent Application Publication No. H8-104291 discloses an invention that generates a gas via a chemical reaction, but with the configuration described therein, the air within the buoyancy bag is expelled out of the buoyancy bag by the water pressure so the water outside the buoyancy bag does not flow into the buoyancy bag. Accordingly, this buoyancy bag cannot serve as a life preserver. Japanese Examined Utility Model Application Publication No. 535-17626, Japanese Examined Utility Model Application Publication No. S35-22525, Japanese Examined Utility Model Application Publication No. S45-13562, and Japanese Examined Utility Model Application Publication No. S63-85493 provide examples of widely known art, but each of these inventions is a life preserver or life preserving apparatus that is separated from the body and worn in addition to a swimsuit or clothing during swimming or work. Therefore, it is necessary to always carry these life preservers, which are impractical to actually use since they are bulky and obstruct work. In the invention of Japanese Utility Model Application Publication No. S62-82900, for the same principle as described above, the air sac does not intake water or sea water, and does not cause a chemical reaction. In the invention of Japanese Patent Application Publication No. H07-223587, the clothing does not intake water or sea water, and air can leak from the air sac or clothing, resulting in a loss of buoyancy.

In a prior art search performed by the Japan Institute of Invention and Innovation, the known art most similar to the present invention was found to be the "buoyancy applying tool" of Japanese Patent Application Publication No. H10-329789, the "life preserving clothing" of Japanese Utility Model Application Publication No. H3-8094, and the "clothing" of Japanese Utility Model Application Publication No. H1-70814, but the differences between the present invention and these prior art examples are shown in Tables 1 and 2. First, when compared with the "buoyancy applying tool" of Japanese Patent Application Publication No. H10-329789, as shown by the effects of Japanese Patent Application Publication No. H10-329789 shown in Table 1, the purpose of this invention is to store and manage a buoyancy applying tool, and this is completely different from the present invention, which is to help a victim during an emergency by expanding a preserver body in the water. This technology is already used in mattress compression bags, and in expanding preserver bodies when in the air. However, the "buoyancy applying tool" of Japanese Patent Application Publication No. H10-329789 does not expand if the air inlet is opened while in the water. This is because, as a condition for the buoyant material in the preserver body to return to the original shape in the water and expand the preserver body, the water pressure applied to the preserver body must be less than the resilient force of the buoyant material, but the resilient force of a buoyant material that can be returned to the original shape by the pressing force exerted by hand also means that the water pressure compresses the material when in the water to prevent a return to the original shape, and even if the material expands somewhat it does not provide enough buoyancy to float a body. Furthermore, with the configuration described in Japanese Patent Application Publication No. H10-329789, if the air supply and exhaust portion 14 shown in the drawings is opened in the water, it is obvious that only water enters in and air cannot be sucked in. In order to intake air while in the water, an air inlet 2*a* must be extended above the water surface, as in the present invention, or the air inlet 2*a* must be extended above the water surface by a blow tube 2 of suitable length. Accordingly, the technology of expanding and compressing the "buoyancy applying tool" of Japanese Patent Application Publication No. H10-329789 is used to store and manage the buoyancy applying tool in a compact state in the air. Therefore, combing the "buoyancy applying tool" of Japanese Patent Application Publication No. H10-329789, the "life preserving clothing" of Japanese Utility Model Application Publication No. H3-8094, and the "clothing" of Japanese Utility Model Application Publication No. H1-70814 would not have the same objective as the present invention, and this combination could not be used to save a life in the water, as the present invention is able to do.

TABLE 1

| Differences | JP 10-329789 | Life Preserver of the Present Invention |
|---|---|---|
| Objective | The objective of the technology described in lines 25 to 43 on page 4 of this document is to store and manage a buoyancy applying tool in a compact state. The technology for achieving this objective is the same as the widely known "mattress compression bag." This document recites the following. "When the buoyant material is flattened and the air inlet is opened, the preserver body is filled with air due to the expansion of the buoyant material returning to an original shape due to resilient force, thereby achieving buoyancy in the preserver body" This technology is the exact same effect as in the widely known "mattress compression bag." | The objective of the life preserver of the present invention is to save a person who is drowning in water. The technology for saving the person in the present invention does not include using a compressed air pump to expand the life preserver. Therefore, this technology is not widely known and is not included in JP H10-329789. |
| Technical Objective | In order to store the buoyancy applying tool in a compact state, the preserver body is compressed and expanded while in the air. (There is absolutely no mention of expanding the preserver body while in the water.) | In order to achieve buoyancy in the water, the preserver body is compressed while in the air and expanded while in the water. (There are descriptions of expanding the preserver body in the water and detailed descriptions and drawings of configurations for expanding the preserver body in the water.) |
| Whether expansion will actually occur in the water (1) | The configuration and position of the air inlet/outlet is not shown in the drawings, and there is no description of a configuration for sucking in air above the water surface. When the buoyancy applying tool is in the water, if the air inlet/outlet, not shown, is actually opened in the water, even the air that is originally in the preserver bag is expelled and only a small amount of buoyancy is achieved. | There is a clear description of the wearer extending the air inlet above the water surface and, in this state, sucking in air from above the water surface. By actually extending the air inlet above the water surface and sucking in air, the buoyancy of the preserver body can be increased greatly. |
| Whether expansion will actually occur in the water (2) | This document recites, "air flows into the preserver body as a result of the buoyant material returning to the original shape and expanding to contain air." But in order for the buoyant material to expand in the water, the resilient force of the buoyant material must be greater than the water pressure. However, there is no description of this, and so the buoyancy applying tool cannot expand in the water. | It is clearly stated in the Specification and drawings that, for the resilient member disposed in the preserver body, there is a condition that the resilient force of the resilient member is greater than the water pressure. Since the life preserver of the present invention fulfills this condition, the preserver body can actually expand and float in the water. |

TABLE 1-continued

| Differences | JP 10-329789 | Life Preserver of the Present Invention |
|---|---|---|
| When in the water | When the wearer wears the buoyancy applying tool and enters the water, the buoyancy applying tool is definitely in an expanded state, which creates a large amount of buoyancy in the water. | When the wearer wears the life preserver of the present invention and enters the water, the life preserver is definitely in a thin and flat state, and does not create a large amount of buoyancy. |
| Operation by the wearer | The wearer can perform the operation of opening the air inlet/outlet while in the air many times. | The wearer performs the operation of opening the inlet only during an emergency, and this operation is usually performed only once. |

TABLE 2

| Differences | JP H3-8094<br>JP H1-70814 | Life Preserver of the Present Invention |
|---|---|---|
| Inlet and outlet structures | Both documents describe a configuration in which the wearer blows air into a tube, and air cannot be sucked in automatically. | In the present invention, the air can be sucked in automatically. |
| Position of the outlet | Both documents describe a configuration in which the inlet is disposed near the neck, such that the head can be inclined to reach the inlet. At this position, the inlet is under the water when the wearer needs buoyancy, and the inlet is not positioned above the water when the wearer is in danger of drowning. | In the present, invention the air inlet can be extended above the surface of the water when the wearer is in danger of drowning. |

PRIOR ART DOCUMENTS

Japanese Patent Application Publication No. 2000-318683, Japanese Patent Application Publication No. 2003-200887, Japanese Examined Patent Application Publication No. 2005-502542, Japanese Patent Application Publication No. H08-104291, Japanese Examined Utility Model Application Publication No. S35-17626, Japanese Examined Utility Model Application Publication No. S35-22525, Japanese Examined Utility Model Application Publication No. S45-13562, Japanese Utility Model Application Publication No. S62-82900, Japanese Utility Model Application Publication No. 563-85493, Japanese Patent Application Publication No. H07-223587, Japanese Patent Application Publication No. H10-329789, Japanese Utility Model Application Publication No. H3-8094, Japanese Utility Model Application Publication No. H1-70814

SUMMARY

In consideration of the problems described above, the present invention has an inexpensive and simple configuration, can be worn casually by adults or children without seeming strange, enables normal swimming by not always exhibiting buoyancy when worn, and exhibits buoyancy when operated by a person during an emergency to enable breathing while waiting for rescue.

In order to achieve the above objectives, the present invention utilizes the resilient force of an elastic member or bias member, i.e. the force to deform when pressure is added and to return to the original shape when the pressure is removed. While an extremely large amount of pressure is applied to the elastic member or the bias member in a preserver body to keep the preserver body in a thin and flat state, the pressure added to the elastic member or the bias member in the preserver body is removed during an emergency, so that resilient force accumulated in this member acts to return the member to the original shape. As a result, air or water is sucked into the preserver body. The volume of the preserver body increases as a result of the resilient force of the elastic member or bias member causing the return to the original shape, thereby sucking in an amount of air or water corresponding to the increased volume. Buoyancy increases due to the sucked-in air or gas generated as the result of a reaction between the sucked-in water and a foaming agent in order to float the body, and this buoyancy enables breathing by keeping the body afloat. Furthermore, a liquid bag is provided in the preserver body, and the liquid bag is torn as the result of pressing or pulling on the preserver body from the outside or by the resilient force obtained by releasing a bias member 3B from a latched state. As a result, reactive liquid sealed in the liquid bag chemically reacts with a foaming agent in the preserver body to generate gas, and the generated gas increases the buoyancy to float the body and enable breathing.

The present invention expands the preserver body by utilizing the resilient force of an elastic member or a bias member that returns to the original shape when pressure is removed. Therefore, compared to the conventional method of transmitting air by an air compression pump, the present invention has an extremely simple configuration and can be manufactured inexpensively, and is not bulky. Therefore, a person can work, swim, or play in the water while wearing the present invention. Furthermore, there is no danger of accidents or incorrect operation. With the conventional method of providing a compressed air pump in order to achieve buoyancy, buoyancy can only be achieved once. With the life preserver of the present invention, however, when a configuration is used in which buoyancy is achieved by sucking in air, sealing the air inlet while the air is removed form the preserver body to create a negative pressure state puts the preserver body in a sealed state, and therefore the preserver body can be used multiple times. Furthermore, when a person is stranded in the water, maintaining energy and warmth is essential to being rescued. With the life preserver present invention, there is no need to move the arms or legs after operation, and the sucked-in air and resilient member (especially the elastic member) disposed in the preserver body serve as thermal insulation. Therefore, wearing the life preserver prevents body heat from being lost.

The liquid bag in the preserver body can be operated by a simple pressing or pulling operation or by releasing a latch from outside the preserver body, and the preserver body can achieve buoyancy with a simple configuration, thereby providing a life preserver that is extremely practical.

When the life preserver of the present invention is worn, the wearer fells safe. Furthermore, since the life preserver has only a small amount of buoyancy in the initial thin and flat state, the wearer can swim while wearing the life preserver in this state while experiencing a small amount of buoyancy. Therefore, the life preserver can be used for a person just learning to swim while providing security and also aiding in swimming.

BRIEF DESCRIPTION OF THE DRAWINGS

FIG. 13A shows an article relating to the present invention.

FIG. 13B shows an article relating to the present invention.

DESCRIPTION OF EXEMPLARY EMBODIMENTS

The following provides a detailed description of a configuration of an exemplary embodiment of a life preserver according to the present invention, based on the drawings. FIGS. 1A to 4C show a configuration for achieving buoyancy by using air that flows into a preserver body. FIGS. 1A to 2F show an exemplary embodiment of the life preserver worn from the shoulders to the torso. FIGS. 4A to 4C show an exemplary embodiment of the life preserver worn on the torso. FIGS. 7A to 10C show a configuration for achieving buoyancy by using a gas generated by a chemical reaction with water (or sea water) flowing into the preserver body. FIGS. 7A to 9F show an exemplary embodiment of the life preserver worn from the shoulders to the torso. FIGS. 10A to 10C show an exemplary embodiment of the life preserver worn on the torso.

Figure 1A:
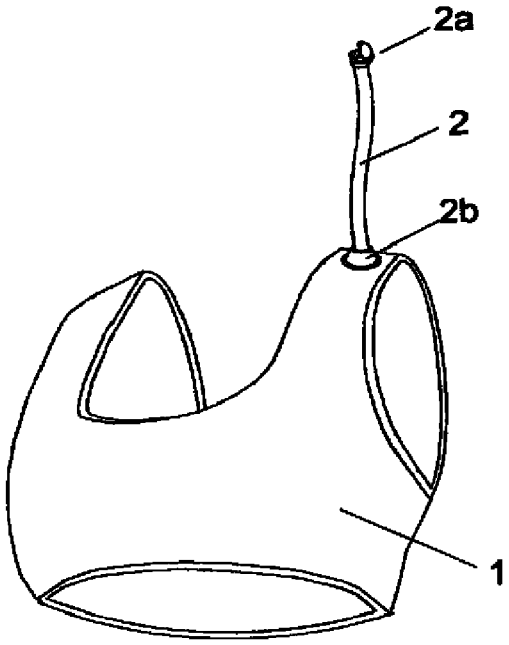
FIG. 1A is a perspective view of an embodiment of the present invention.

The life preserver of the present invention shown in FIGS. 1A to 2F is shaped as gear to be worn by a woman participating in sporting competitions or beach volleyball, but the life preserver of the present invention can be used by both men and women. FIG. 1A is a perspective view of the life preserver, and FIG. 1B shows a state in which the life preserver is actually worn. FIG. 2A is a front view of the life preserver, and FIGS. 2B, 2C, and 2D are vertical cross-sectional views of the life preserver as seen from the x-y direction.

Figure 2A:
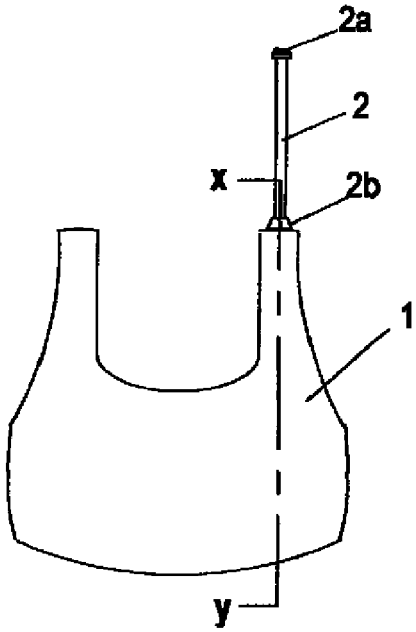
FIG. 2A is a front view of an embodiment of the present invention.
Figure 2B:
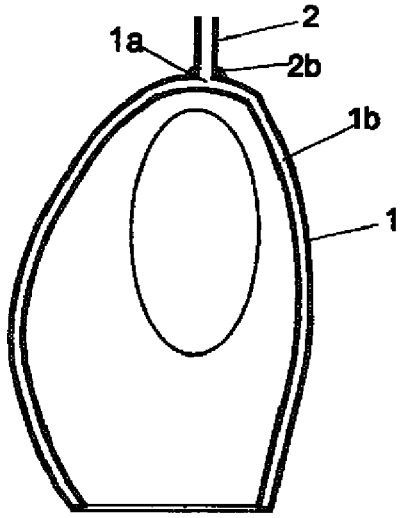
FIG. 2B is a vertical cross-sectional view of an embodiment of the present invention as seen from the x-y direction of FIG. 2A.
Figure 3A:
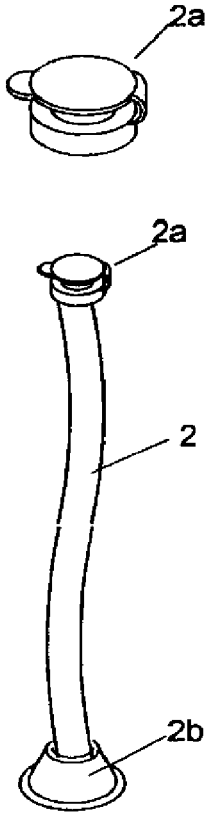
FIG. 3A is a perspective view of a portion of an embodiment of the present invention.

As shown in FIG. 2B, a hollow region 1*b* sealed from the outside is formed in the preserver body 1 that serves as the life preserver of the present invention, and a blow tube 2 that enables outside air to enter into the hollow region 1*b* is formed at the top of the preserver body 1. The blow tube 2 that sucks in the outside air is securely fixed by a fixing portion 2*b* to an air inlet 1*a* formed at the top of the preserver body 1, such that the blow tube 2 does not easily come loose. An air inlet 2*a* is disposed at the tip of the blow tube 2, to intake the outside air. As one embodiment, the air inlet 2*a* includes a lid on the inlet through which the air is sucked in, as shown in FIG. 3, and can therefore be in an open state or an artificially sealed state.

Figure 5A:
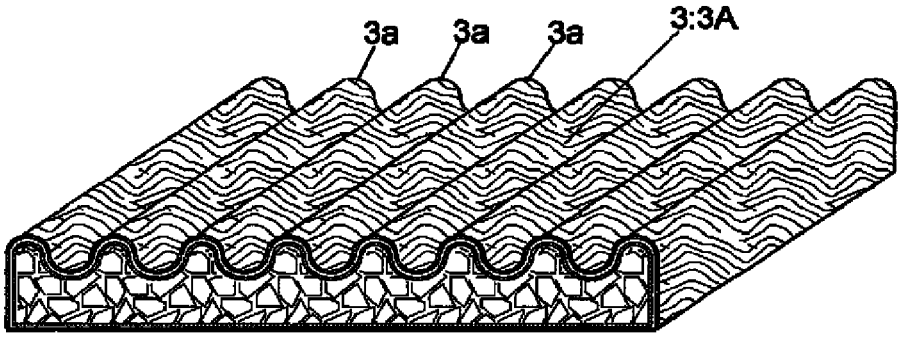
FIG. 5A is a perspective view of an embodiment of the present invention.
Figure 5B:
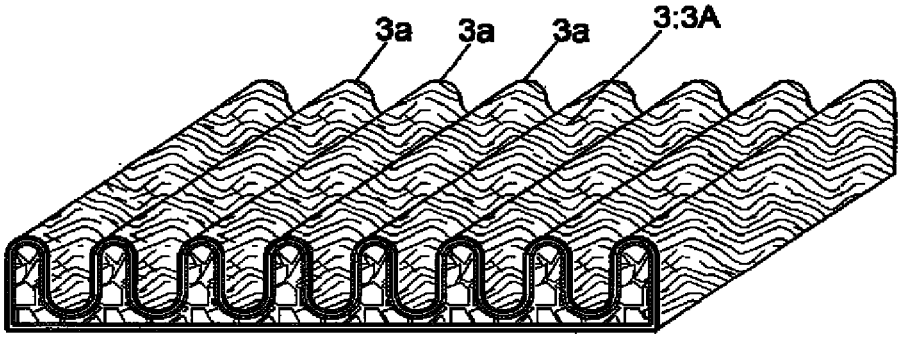
FIG. 5B is a perspective view of an embodiment of the present invention.
Figure 5C:
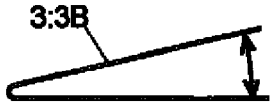
FIG. 5C is a front view of an embodiment of the present invention.
Figure 5D:
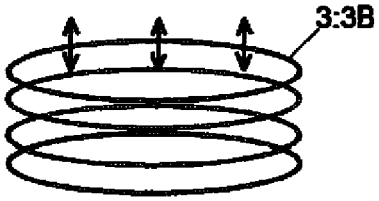
FIG. 5D is a front view of an embodiment of the present invention.

With this configuration, the hollow region 1*b* is filled with a material serving as a resilient component 3, which deforms when pressure (a load) is added thereto from the outside and returns to an original unloaded form when the pressure (load) is removed. The resilient component 3 can be realized by an elastic member 3A, such as an elastic foam material, or a bias member 3B that deforms when pressure is added and returns to the original shape when the pressure is removed. The elastic member 3A can be realized by a plastic foam, as in the present embodiment, and the plastic foam can be continuous or non-continuous. The plastic foam can be polystyrene foam, polyurethane foam (sponge), polyethylene foam, or polypropylene foam, for example. Each of these foams is elastic, deforms to have less volume in proportion to pressure added thereto, and returns to the original shape and volume due to elastic force when the deforming pressure is removed. With this deformation, air is sucked in or expelled to or from the inside of the foam plastic according to the amount of deformation. Therefore, the plastic foam is sealed in the hollow region 1*b*, and when the air is removed from within the hollow region 1*b* or pressure is added from outside the hollow region 1*b*, the plastic foam sealed therein is deformed to be smaller, thereby deforming the overall preserver body 1 to have less volume. Next, when air enters into the hollow region 1*b*, the hollow region 1*b* returns to the original volume due to the resilient force of the elasticity of the plastic foam, and at the same time the overall preserver body 1 returns to the original shape (volume). As an embodiment of the bias member 3B, a bias member 3B such as a flat spring or a compression spring, such as shown in FIGS. 5C and 5D, is provided in the hollow region 1*b*. By removing the air from the hollow region 1*b* or adding pressure to the bias member 3B from outside the preserver body 1, the volume of the overall preserver body 1 is decreased, thereby realizing the present invention in the same manner as the elastic member 3A. The bias member 3B can be realized by material other than a metal such as iron, and can be made of a rubber of plastic material having flexibility, for example. The elastic member 3A can also be realized by an elastic member other than plastic, such as a rubber material.

In this way, the present invention uses the resilient characteristics of the elastic member 3A or the bias member 3B disposed within the sealed hollow region 1*b* to return these members to the original shapes when pressure is removed to achieve an unloaded state. Both of these members deform by bending or having reduced volume when a load is placed thereon adding pressure from the outside, and return to the original volume and shape when the pressure is removed. In accordance with the deformation of the elastic member 3A or the bias member 3B, air flows into the sealed hollow region 1*b*. The present invention utilizes the resilient properties by increasing or decreasing pressure on the resilient component 3, in order to suck in or expel air to or from the hollow region 1*b*, and therefore the present invention truly utilizes natural laws.

Figure 2C:
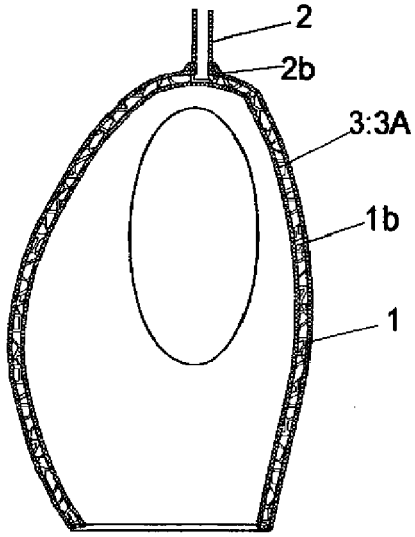
FIG. 2C is a vertical cross-sectional view of an embodiment of the present invention as seen from the x-y direction of FIG. 2A.
Figure 2D:
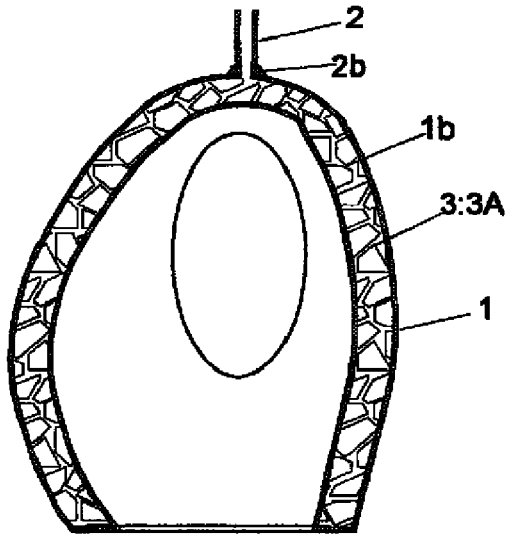
FIG. 2D is a vertical cross-sectional view of an embodiment of the present invention as seen from the x-y direction of FIG. 2A.

The following describes one example of a method for manufacturing the life preserver of the present invention. First, as shown in FIG. 2D, melamine foam, which is a plastic foam, is enclosed within the hollow region 1*b* of the preserver body 1 as the elastic member 3A. Next, in order to remove the air from within the hollow region 1*b*, the air may be sucked out from the hollow region 1*b* through the blow tube 2 using a vacuum pump apparatus, for example, or by pressing the entire preserver body 1 with a press machine, for example, to expel the air from the hollow region 1*b*. After the air is removed from the hollow region 1*b*, as shown in FIG. 3A, the opening of the air inlet 2*a* is closed in a sealed state or the opening is completely closed by being fused (laminated) by thermo-compression bonding, for example, thereby causing the overall preserver body 1 to be in a thin and flat state as shown in FIG. 2C. The inventor of the present invention actually pressed melamine foam with a thickness of 32 mm by adding a large amount of pressure, and was able to compress the melamine foam with a thickness of 32 mm to a thickness of merely 1 mm. If the preserver body 1 is formed by melamine foam compressed to a thickness of 1 mm in this way, this thickness is practically the same as that of sportswear used in competitions such as triathlons or a common swimsuit that has almost no buoyancy.

Figure 1B:
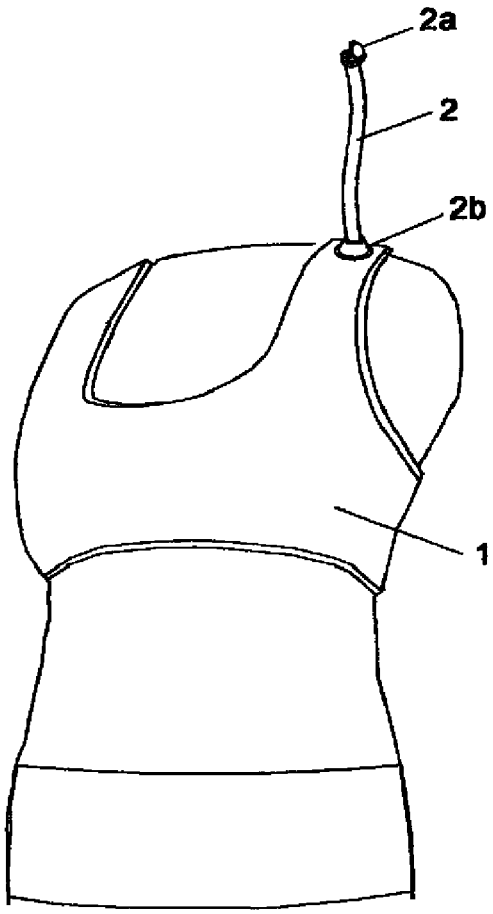
FIG. 1B is a perspective view of an embodiment of the present invention.
Figure 1C:
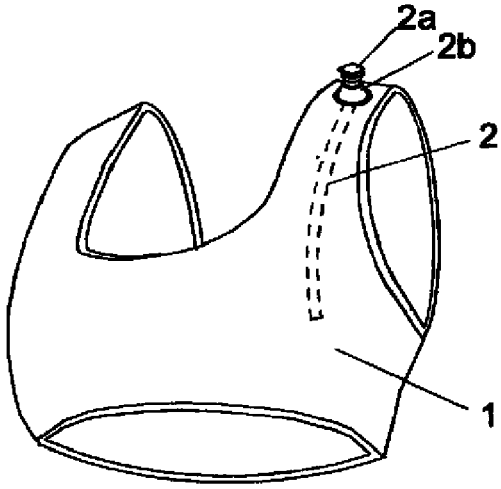
FIG. 1C is a partially transparent perspective view of an embodiment of the present invention.

The following describes a method for wearing and operating the life preserver of the present invention. FIG. 1B shows a state in which the life preserver is worn, and the thin and flat preserver body 1 fits on the body without being bulky. Here, the blow tube 2 that transmits air into the hollow region 1*b* in the preserver body 1 is stored in a coiled state, as one example, within a pocket, not shown, which is bent as necessary and disposed on the back surface of the preserver body 1. As shown in FIG. 1C, the blow tube 2 can be stored by being inserted straight into the hollow region 1*b* of the preserver body 1. As shown in FIGS. 3C and 3D, the blow tube 2 may have a circular cross section or an elliptical cross section, and can be stored in a thin and flat state if an elliptical cross section is chosen. With the elliptical shape shown in FIG. 3D, when the preserver body 1 has a large amount of pressure added thereto, the blow tube 2 becomes a flat board with no opening therein, and can therefore be stored without being bulky. As shown by the embodiment shown in FIG. 1B, the blow tube 2 can be formed to stand erect by its own elasticity (flexibility).

Figure 6A:
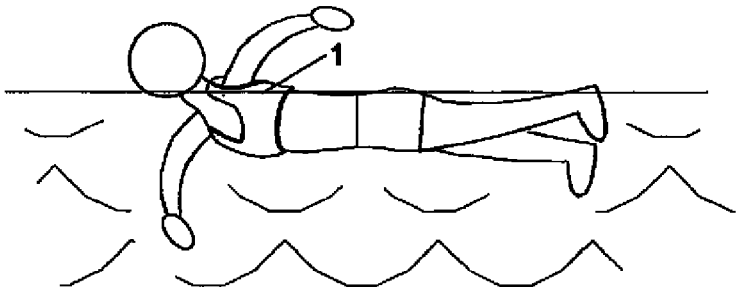
FIG. 6A is a front view of the present invention in use.

As shown in FIG. 6A, the life preserver of the present embodiment can be worn while swimming and the life preserver has a thin and flat shape, and therefore there is no interference when swimming since the buoyancy of the overall preserver body 1 is not active. Furthermore, the sealing state of the air in the hollow region 1*b* can be adjusted such that the overall preserver body 1 has only a small amount of buoyancy, and in this state the upper portion of the body is made slightly buoyant, making swimming easier. Therefore, the life preserver can serve as a swimming aid while also providing security to someone who is beginning to learn to swim. The buoyancy of the preserver body 1 can also be set as desired by the user.

Figure 2E:
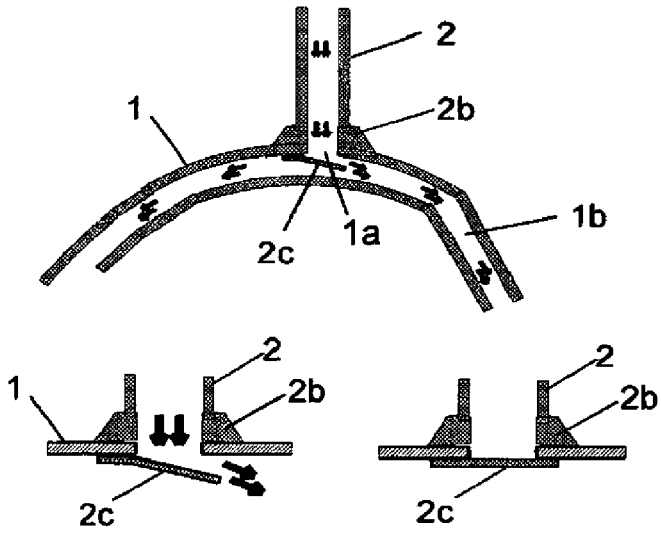
FIG. 2E is a vertical cross-sectional view of an enlarged portion of an embodiment of the present invention.
Figure 3B:
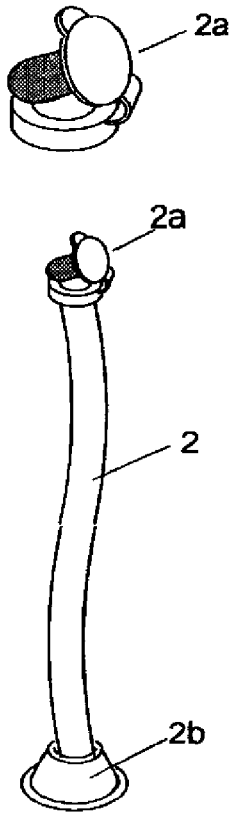
FIG. 3B is a perspective view of a portion of an embodiment of the present invention.
Figure 3C:
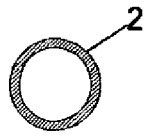
FIG. 3C is a horizontal cross-sectional view of a portion of an embodiment of the present invention.
Figure 3D:
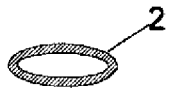
FIG. 3D is a horizontal cross-sectional view of a portion of an embodiment of the present invention.
Figure 4A:
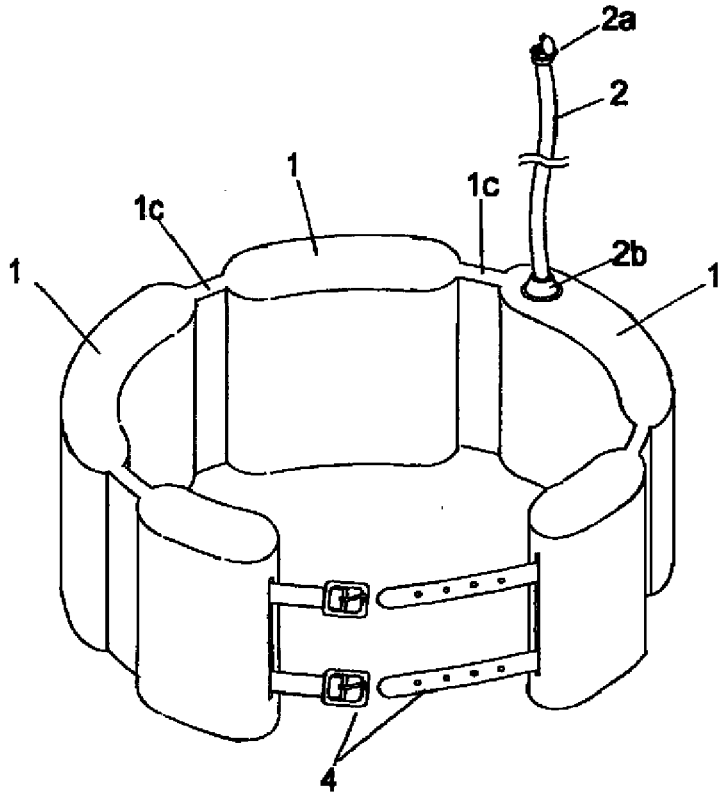
FIG. 4A is a perspective view of an embodiment of the present invention.
Figure 4B:
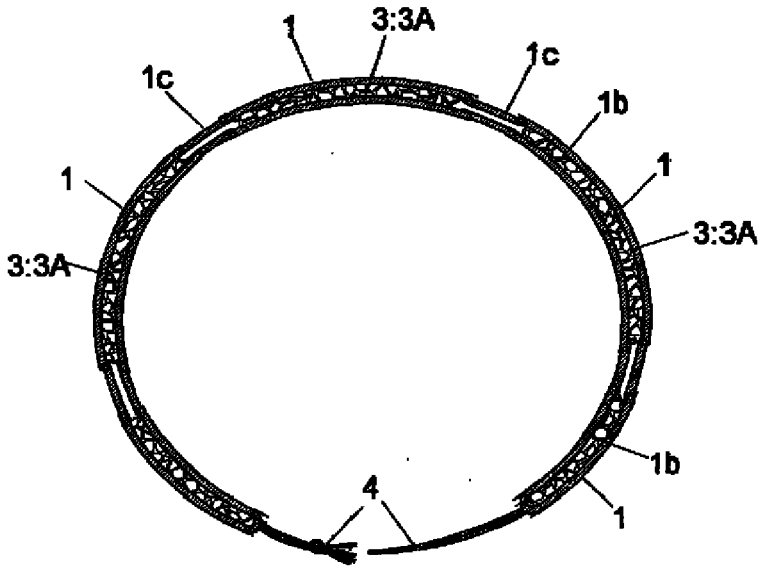
FIG. 4B is a horizontal cross-sectional view of an embodiment of the present invention.
Figure 4C:
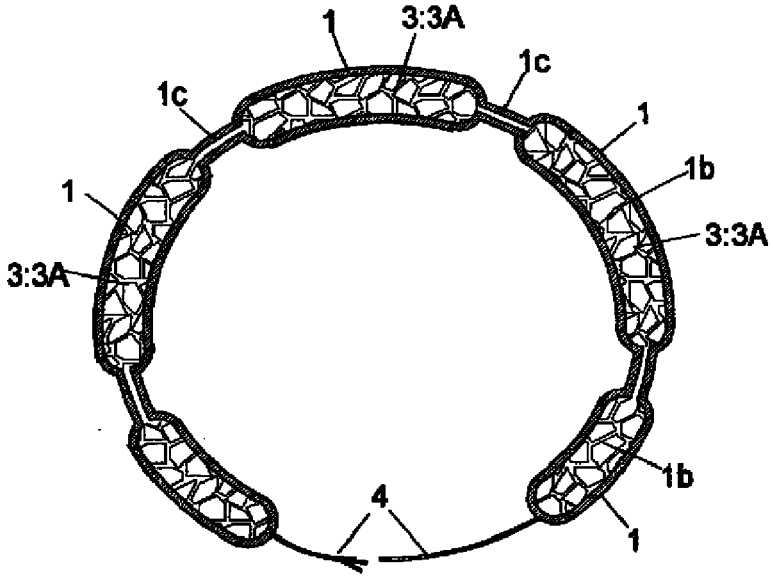
FIG. 4C is a horizontal cross-sectional view of an embodiment of the present invention.
Figure 6B:
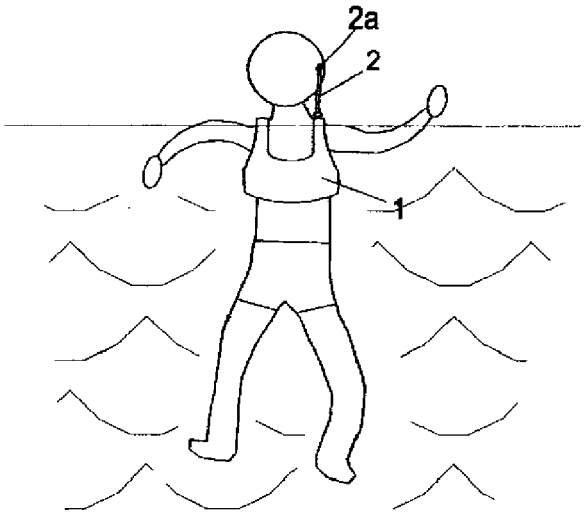
FIG. 6B is a front view of the present invention in use.

As shown in FIG. 6B, when a swimmer becomes exhausted or when someone who cannot swim is somewhere so deep that their feet cannot touch the ground, the blow tube 2 stored in the preserver body 1 is removed and the air inlet 2*a* at the tip of the blow tube 2 can be opened (in the present embodiment, a lid is opened), as shown in FIG. 3B. When this happens, the elastic member 3A in the loaded state, which is a foaming material that is compressed and fills the hollow region 1*b* of the preserver body 1, changes to an unloaded state and the resilient (elastic) force thereof causes the elastic member 3A to expand and return to the original shape. This expansion of the elastic member 3A causes the volume within the hollow region 1*b* to increase, and therefore an amount of air corresponding to this increased volume is sucked into the hollow region 1*b* through the opened air inlet 2*a*. The buoyancy of this sucked-in air affects the entire preserver body 1 such that, as shown in FIG. 6B, the head of the person wearing the life preserver is kept above the water enabling the person to breathe, and the person can remain in this state until help arrives. FIG. 2E shows a configuration in which an air valve 2*c* is provided on the fixing portion 2*b* of the air inlet 2*a*. This configuration causes the air that is sucked in to the hollow region 1*b* to be held therein by the air valve 2*c*, and prevents the air sucked into the hollow region 1*b* from flowing back out through the blow tube 2. The air valve 2*c* can have the same configuration as valves used in conventional buoyancy bags, and when the user wants to remove the air from within the hollow region 1*b*, the air can be removed by pinching the fixing portion 2*b* with the fingers to open the air valve 2*c*. In an actual state where the life preserver of the present invention is worn and the entire preserver body 1 is floating, water does not enter into the hollow region 1*b* through the air inlet 2*a* even when the air inlet 2*a* is open.

Figure 2F:
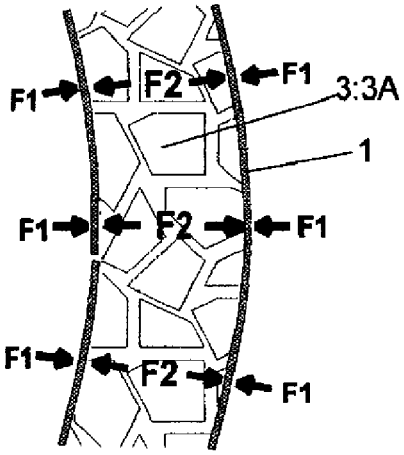
FIG. 2F is a vertical cross-sectional view of an enlarged portion of an embodiment of the present invention.

FIG. 2F describes a relationship between the water pressure F1 added to the preserver body 1 and the resilient force F2 of the bias member 3A. When the preserver body 1 is submerged in water, the water pressure F1 is applied horizontally to the surface of the preserver body 1 in proportion to the how deep in the water the preserver body 1 is. The water pressure F1 exerted on the surface of the preserver body 1 exerts a uniform pressure within the hollow region 1*b* of the preserver body 1, according to Pascal's principle, and therefore the water pressure F1 is added to each portion of the elastic member 3A disposed in the hollow region 1*b*. The elastic member 3A deformed by the addition of pressure thereto exerts a resilient force F2 that attempts to return the elastic member 3A to the original shape. When the resilient force F2 is greater than the water pressure F1, the preserver body 1 naturally expands as air is sucked in through the air inlet 2*a*. As an actual embodiment of this, the inventor of the present invention filled a preserver body 1 with an elastic member 3A made of melamine foam serving as a plastic foam. After an extremely large pressure was applied to compress the preserver body 1 into a thin and flat state, and the preserver body 1 was submerged in water to a depth of 50 cm. At this point, as the preserver body 1 returned to the original form due to the resilient force of the melamine foam, air was sucked in through the air inlet 2*a* and the preserver body 1 expanded, thereby confirming through actual experimentation that the resilient force F2 of the melamine foam, which is the foam material, is greater than the water pressure F1 at a depth of 50 cm. Accordingly, when the hollow region 1*b* of the preserver body 1 is filled with a compressed elastic member 3A made of melamine foam serving as the plastic foam, even in a state where the head is submerged in the water as shown in FIG. 6B, if the air inlet 2*a* at the tip of the blow tube 2 is grasped and set above the water surface and the air inlet 2*a* is opened while the air inlet 2*a* is above the water surface, the air sucked in through the air inlet 2*a* enters into the submerged preserver body 1, and the buoyancy of the sucked-in air lifts the head above the water surface to enable breathing. For someone who is actually drowning, reaching a state that allows breathing is an essential factor for future rescue. For someone who simply does not have the strength to continue swimming, being able to breath and remain afloat without moving the arms and legs can be very helpful, and therefore the life preserve of the present invention should be able to save many people. An actual potential drowning incident can occur in a moment, and when someone who cannot swim reaches a place where their feet cannot touch the ground they become unable to protect themselves. There are many drowning victims every summer as a result of these sudden incidents, and it would be great if even just one person were saved by wearing the life preserver of the present invention when they are near the water.

Figure 3E:
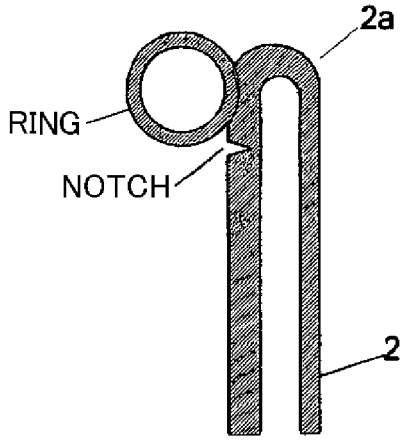
FIG. 3E is a vertical cross-sectional view of a portion of an embodiment of the present invention.

The configuration for the air inlet 2*a* at the tip of the blow tube 2 may differ from the configuration shown in FIGS. 3A and 3B, and any configuration can be used for the air inlet 2*a* as long as the inlet can be opened. For example, as shown in FIG. 3E, a notch can be formed on a side of the blow tube 2 and the air inlet 2*a* can be opened from the notch by inserting a finger into a ring portion formed thereabove and pulling. The air inlet 2*a* is preferably configured in a manner to be opened with one hand.

Figure 6C:
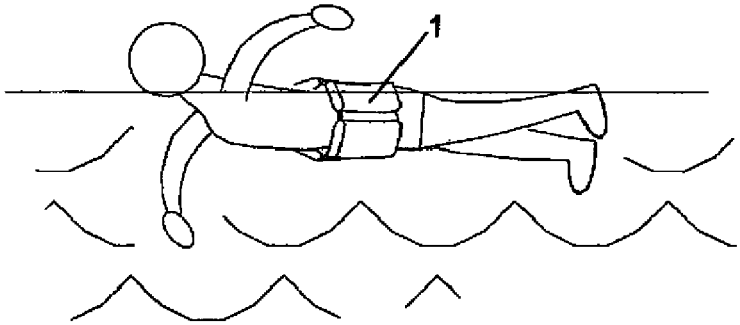
FIG. 6C is a front view of the present invention in use.
Figure 7A:
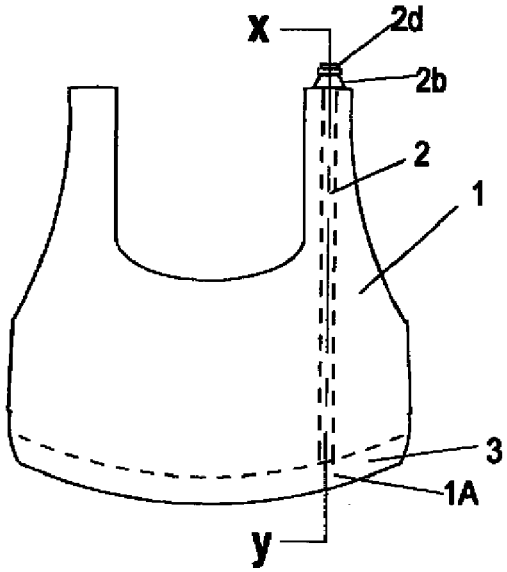
FIG. 7A is a front view of an embodiment of the present invention.
Figure 7B:
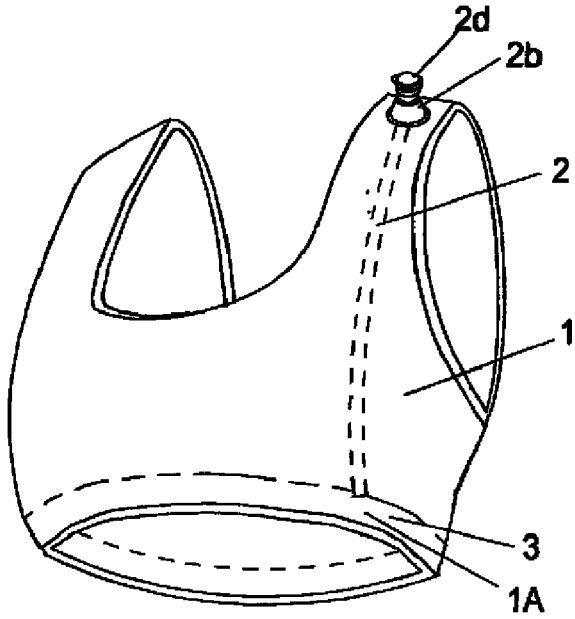
FIG. 7B is a perspective view of an embodiment of the present invention.
Figure 7C:
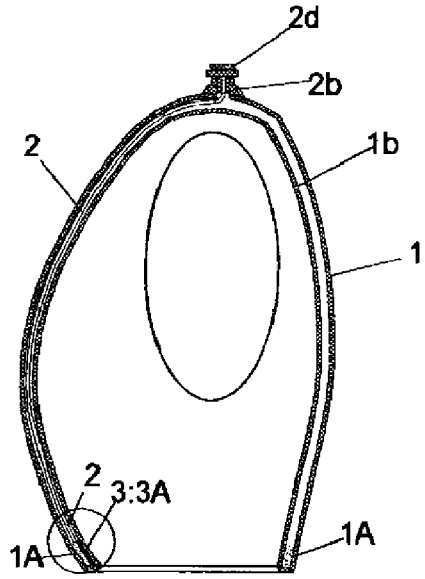
FIG. 7C is a vertical cross-sectional view of an embodiment of the present invention as seen from the x-y direction of FIG. 7A.
Figure 7D:
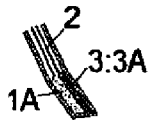
FIG. 7D is a vertical cross-sectional view of an enlarged portion of an embodiment of the present invention.
Figure 7E:
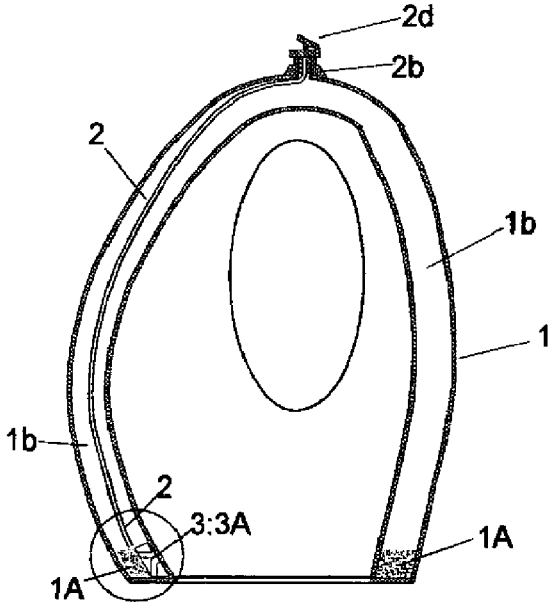
FIG. 7E is a vertical cross-sectional view of an embodiment of the present invention as seen from the x-y direction of FIG. 7A.
Figure 7F:
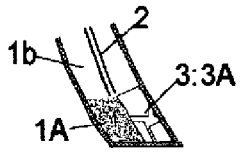
FIG. 7F is a vertical cross-sectional view of an enlarged portion of an embodiment of the present invention.
Figure 7G:
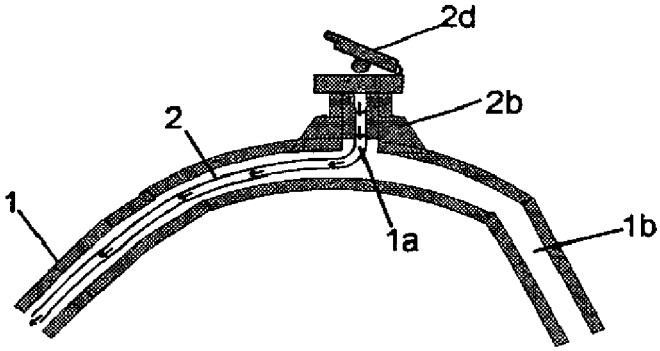
FIG. 7G is a vertical cross-sectional view of an enlarged portion of an embodiment of the present invention.
Figure 8A:
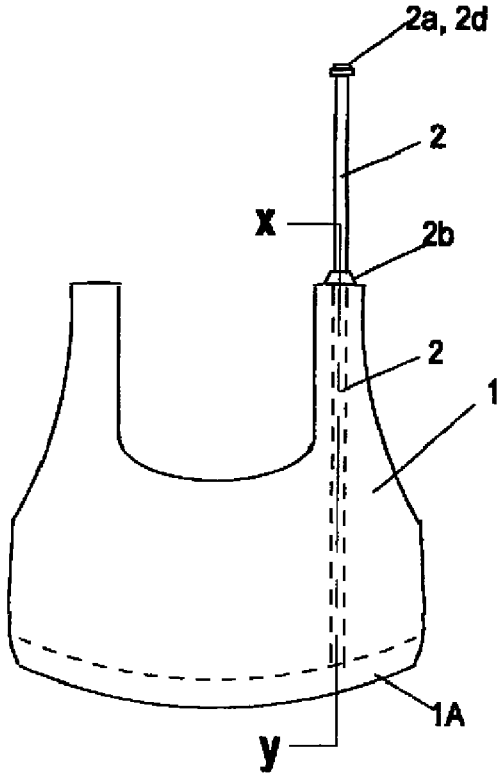
FIG. 8A is a front view of an embodiment of the present invention.
Figure 8B:
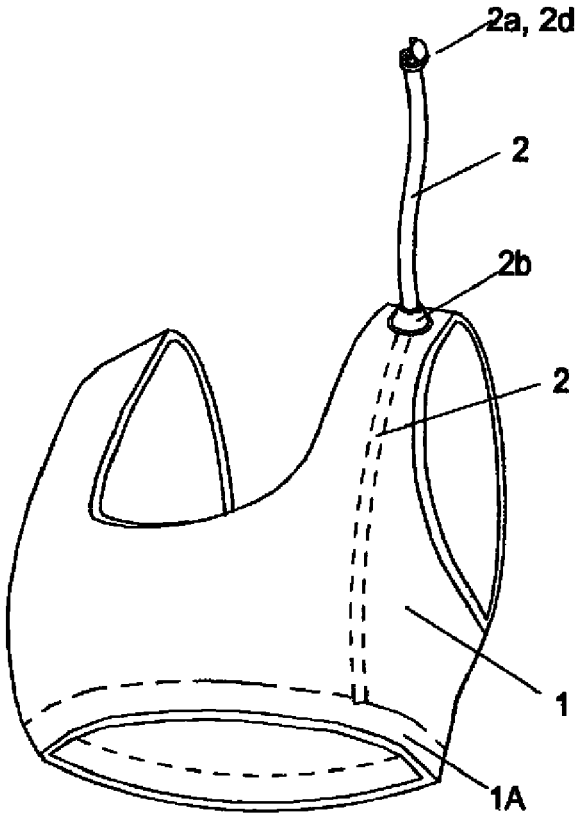
FIG. 8B is a perspective view of an embodiment of the present invention.
Figure 8C:
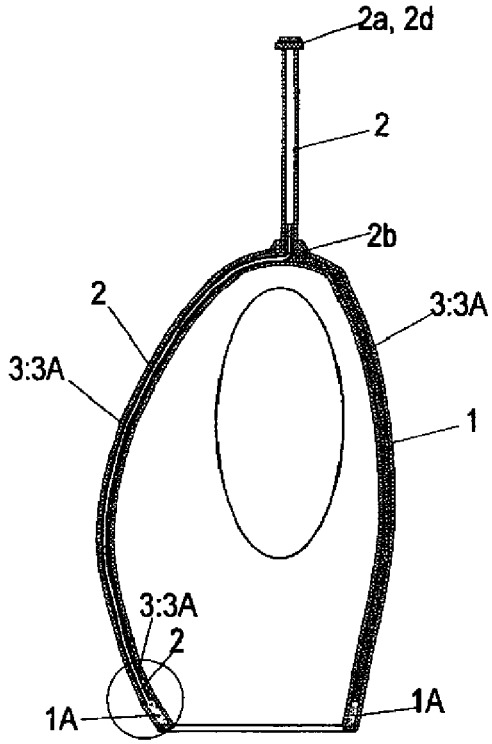
FIG. 8C is a vertical cross-sectional view of an embodiment of the present invention as seen from the x-y direction of FIG. 8A.
Figure 8D:
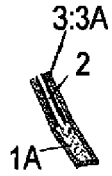
FIG. 8D is a vertical cross-sectional view of an enlarged portion of an embodiment of the present invention.
Figure 8E:
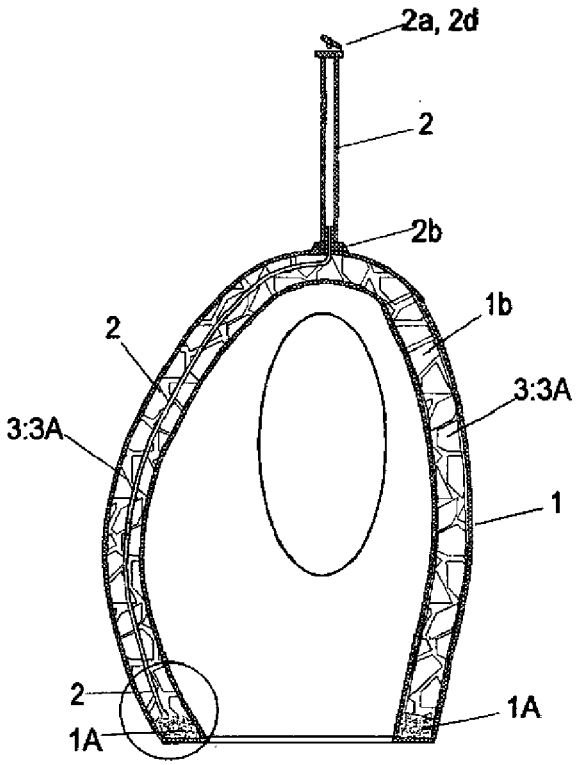
FIG. 8E is a vertical cross-sectional view of an embodiment of the present invention as seen from the x-y direction of FIG. 8A.
Figure 8F:
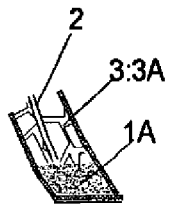
FIG. 8F is a vertical cross-sectional view of an enlarged portion of an embodiment of the present invention.

FIGS. 4A to 4C show a second exemplary embodiment of the life preserver according to the present invention. As shown in the drawings, a plurality of preserver bodies 1 are provided and a hollow region 1*b* is formed in each preserver body 1, and the hollow regions 1*b* are in communication with each other via communicating holes 1*c*. With this configuration, the hollow region 1*b* in each preserver body 1 is filled with a resilient member 3, and air can move freely among the hollow regions 1*b* via the communicating holes 1*c*. FIG. 4B shows a state in which the hollow regions 1*b* are filled with compressed elastic members 3A. FIG. 4C shows a state in which the air inlet 2*a* is opened and air is sucked in through the air inlet 2*a* by the resilient force of the elastic members 3A, thereby returning the preserver body 1 to the original shape. According to Pascal's principle, a sealed bag experiences a uniform pressure at all points, and therefore each preserver body 1 is compressed with the same pressure and expands with the same pressure when air is sucked in through the air inlet 2*a*. With the configuration of the present embodiment, the life preserver can be wrapped around the torso, allowing for swimming and playing in the water as in the state shown by FIG. 6C. When there is an emergency, the life preserver can be shifted to the upper torso to keep the head floating above the water surface and enable breathing, as shown in FIG. 6B, while keeping the body afloat without movement of the arms or legs. The configuration of the present embodiment includes a fastener band 4 that wraps the life preserver around the torso, and the life preserver is fixed securely in place around the torso by a buckle. The fastener band 4 is preferably configured to enable secure fastening, and since there is a concern that Velcro (Registered Trademark: Magic Tape) can slip, the fastener band 4 preferably includes a fastener that can be locked.

In the life preserver of the present embodiment, the air inlet 2*a* may have any configuration that enables the inlet to be opened, and it is preferable that the opening operation be performable with one hand. The length and thickness of the blow tube 2 may be set as desired. The length of the blow tube 2 can be set up to a length that us as far as a hand can be extended, in order to enable even a drowning person to reliably operate the blow tube 2 above the water surface. The elastic member 3A that is compressed and fills the preserver body 1 may include a plurality of uneven portions 3*a*, as shown in FIGS. 5A and 5B. With this configuration, an elastic member 3A with a strong resilient force can be realized, and therefore a lesser amount of the elastic member 3A can be used and the time needed for the elastic member 3A to return to the original shape can be reduced.

In the life preserver of the present invention, the air sucked into the preserver body 1 and the resilient member 3 (particularly the elastic member 3A) disposed in the preserver body 1 have extremely high specific heat, and therefore achieve a thermal insulation effect. When the life preserver of the present invention is worn, body temperature can be trapped near the body and prevented from escaping, and keeping this body heat trapped can increase the length of time that a person can wait to be rescued. Furthermore, the life preserver of the present invention is not bulky, and therefore can also be worn as normal clothing for warmth.

With conventional life preservers, the attached air compression pump can only be used once, but with the life preserver of the present invention, by expelling the air from the preserver body 1 by applying pressure from the outside or by sucking the air out of the preserver body 1 from the outside and then closing the air inlet 2*a* while there is no air in the preserver body 1, the preserver body 1 can again achieve a sealed state and can be reused as many times as needed.

Figure 11A:
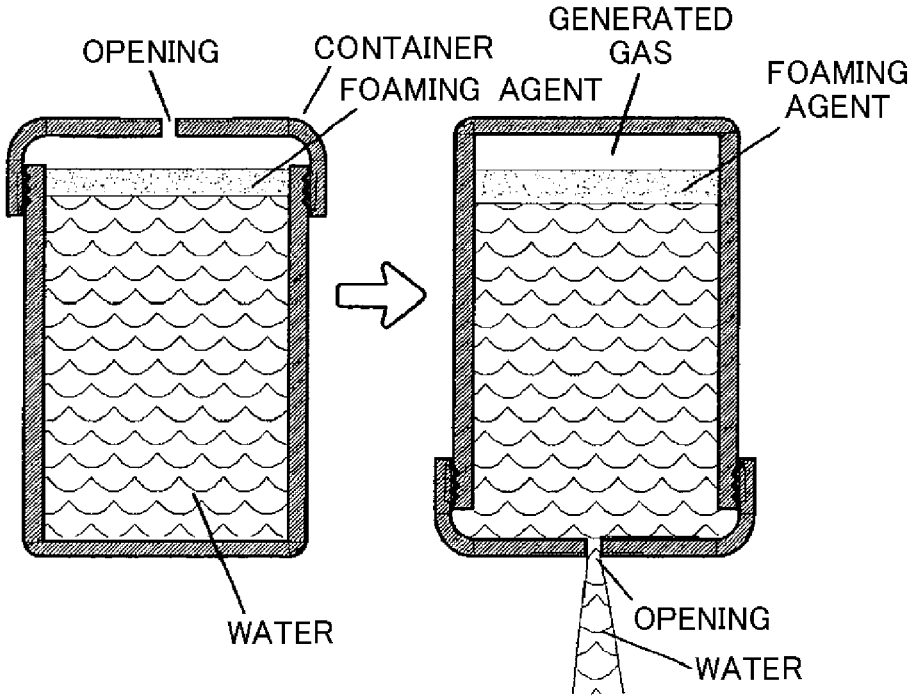
FIG. 11A is a vertical cross-sectional view of an embodiment of the present invention.

FIGS. 7A to 9F show a third exemplary embodiment of the life preserver of the present embodiment. The previous embodiments are designed such that air is sucked in from above the water surface and used to achieve buoyancy. In the present embodiment, however, buoyancy can be obtained even if sea water from the ocean or water from a pool, river, or lake is sucked in. In order to achieve this effect, a foaming agent is used that generates gas by having a chemical reaction with water. The foaming agent can be an additive that is added to baths, for example. The inventor of the present invention actually performed the test shown in FIG. 11A using, commercially available additives including sodium hydrogen carbonate, sodium carbonate, fumaric acid, polyethylene glycol 6000, dextrin, zinc paraphenolsulfanate, magnesium oxide, and sucrose fatty acid ester. First, water was poured into a 200 cc bottle up to 80%, as shown in the drawings, 18 grams of the additive was crushed into a powder and poured into the water, a lid with an opening was placed on the bottle as shown in the drawings, and the bottle was then quickly turned upside down. When this happened, gas (carbon dioxide gas) was generated very quickly, water was expelled forcefully from the opening at the bottom, and the water in the bottle was pressed by the gas (carbon dioxide gas) to be completely expelled within a few seconds. Therefore, when gas (carbon dioxide gas) is generated quickly to fill the preserver body 1, the preserver body 1 becomes buoyant in the same manner as in the previous embodiments, to float above the water surface.

Therefore, in the same manner as the previous embodiments, the present embodiment utilizes the resilient force (i.e. the force to deform when pressure is added and to return to the original shape when the pressure is removed) of the bias member 3B or the elastic member 3A, which serve as the resilient member, and the configuration of this embodiment is described in detail below based on the drawings.

In FIG. 7, a water inlet 2*d* is disposed in an upper portion of the preserver body 1 and the blow tube 2, which transmits water sucked in through the water inlet 2*d* downward into the hollow region 1*b* of the preserver body 1, is disposed within the hollow region 1*b*. A foaming portion 1A filled with the foaming agent and the elastic member 3A are disposed together below the exhaust end of the blow tube 2. With the configuration shown in FIGS. 7C and 7D, the air within the hollow region 1*b* of the preserver body 1 is sucked out by a vacuum pump or the like to form a vacuum state or the entire preserver body 1 is pressed with a large amount of pressure to remove enough air from the preserver body 1 that the preserver body 1 becomes flat and thin, an the water inlet 2*d* is then closed to keep the preserver body 1 in a sealed state. In this state, a pressure (load) is constantly applied to compress the elastic member 3A disposed at the bottom of the hollow region 1*b*. In this state, the resilient force of the elastic member 3A for returning to the original shape is held in check. As shown in FIG. 7G, when the lid of the water inlet 2*d* is opened, water is sucked into the hollow region 1*b* and pressure is no longer added to the elastic member 3A, resulting in an unloaded state. Therefore, the elastic member 3A attempts to return to the original rough state from the compressed dense state according to the resilient force, and increase in volume caused by the deformation of the elastic member 3A creates a negative pressure state within the hollow region 1*b*. As a result, an amount of water corresponding to the negative pressure within the hollow region 1*b* is sucked through the inlet of the water inlet 2*d* in the direction of the arrows. This sucked-in water flows to over the foaming portion 1A at the bottom of the hollow region 1*b*, thereby causing a chemical reaction between the foaming agent of the foaming unit 1A and the water to begin generating gas. The generated gas (carbon dioxide gas) gradually fills the hollow region 1*b* until, as shown in FIG. 7E, the generated gas (carbon dioxide gas) creates buoyancy in the preserver body 1. Therefore, when the life preserver of the present embodiment is worn, this generated buoyancy is used to enable floating on the water surface. The amount of foaming agent disposed in the hollow region 1*b* should sufficient to completely fill the hollow region 1*b* with the gas generated as a result of the chemical reaction with the water. After this amount of gas has been generated, the water inlet 2*d* can be closed again to prevent the generated gas from leaking to the outside. Furthermore, the present embodiment includes a valve that opens only in the direction in which the water is sucked-in, as shown in FIG. 2E, within the blow tube 2 passing to the water inlet 2*d*, and therefore the generated gas in the preserver body 1 is prevented from leaking to the outside. The foaming agent may be injected within the elastic member 3A in advance such that, when the elastic member 3A expands, the gas is generated by the chemical reaction with the foaming agent as the water is sucked in.

FIG. 8 shows a configuration through which the preserver body 1 achieves buoyancy due to the expansion of the hollow region 1*b* regardless of whether water or air is sucked into the hollow region 1*b* of the preserver body 1. When air above the water surface is to be sucked in, the air inlet 2*a* is opened while protruding above the water surface in the state shown in FIG. 8C, in the same manner as in the embodiment shown in FIGS. 1A to 2F. At this point, the resilient force of the elastic member 3A that is compressed and fills the entire hollow region 1*b* acts to suck in air through the opened air inlet 2*a* into the hollow region 1*b*, causing the entire preserver body 1 to expand as shown in FIG. 8E. In the same manner as in the previous embodiments, the preserver body 1 then achieves buoyancy and can float on the water surface. Next, the air inlet 2*a* can also be used as the water inlet 2*d*, and when opened in a submerged state as the water inlet 2*d*, the resilient force of the elastic member 3A within the hollow region 1*b* acts to cause expansion, while at the same time the unloaded state is achieved in the hollow region 1*b*. Therefore, water is sucked in through the water inlet 2*d* and this sucked-in water flows over the foaming agent of the foaming portion 1A disposed at the bottom of the hollow region 1*b*. As a result, the foaming agent causes a chemical reaction with the sucked-in water to generate gas (carbon dioxide gas) in the same manner as in the previous embodiments. Since the elastic member 3A expands at the same time, this gas (carbon dioxide gas) is sucked into the elastic member 3A during the expansion. The state shown in FIG. 8E is then reached, and the overall preserver body 1 achieves buoyancy to float above the water surface. In the present embodiment, the resilient force of the elastic member 3A in the hollow region 1*b* is always active, and therefore the hollow region 1*b* is prevented from collapsing by the resilient force. Therefore, even after the gas-generating reaction of the foaming agent ends, water does not flow from the water inlet 2*d*, and so there is no need to include the valve that is used in the previous embodiments. Even if someone is drowning and lacks the calmness to open the air inlet 2*a* above the water surface as shown in FIG. 6B, the water inlet 2*d* can be opened while under water such that water flows into the hollow region 1*b* and reacts with foaming agent to generate gas. Therefore, even when the water inlet 2*d* is opened in water, the same state as shown in FIG. 8E is achieved, where the entire preserver body 1 achieves buoyancy and can float above the water surface.

Figure 9A:
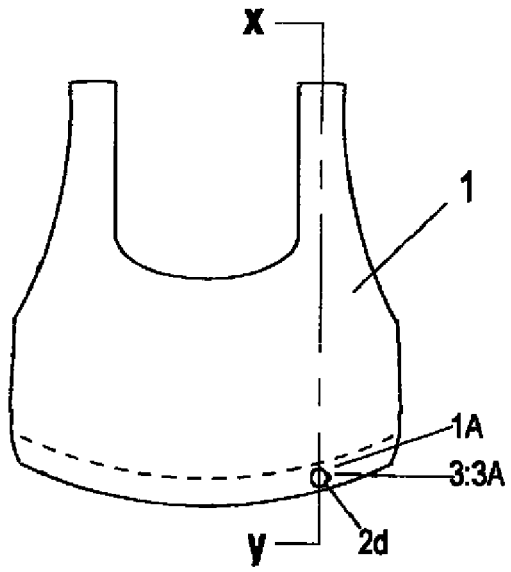
FIG. 9A is a front view of an embodiment of the present invention.
Figure 9B:
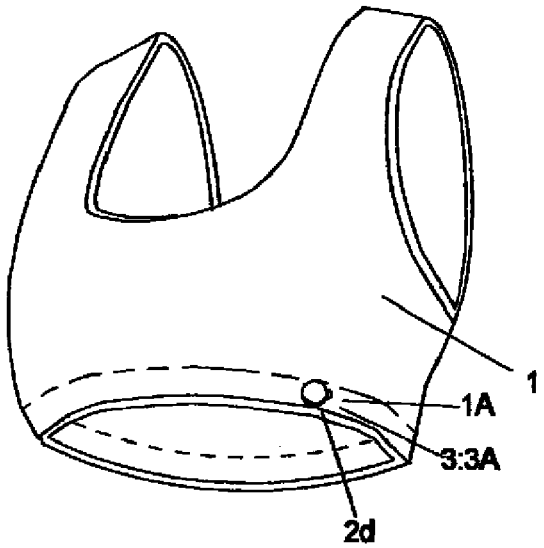
FIG. 9B is a perspective view of an embodiment of the present invention.
Figure 9C:
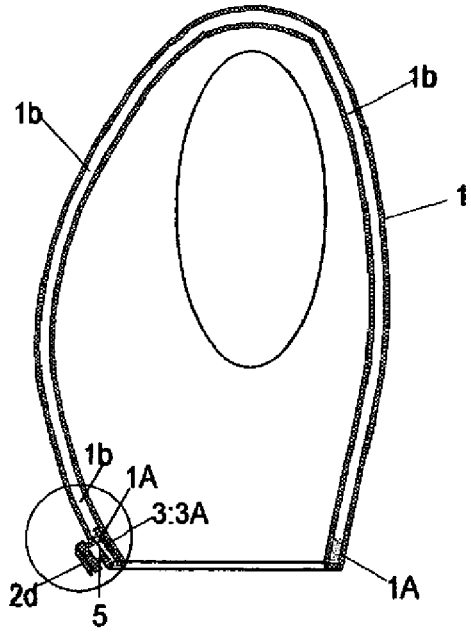
FIG. 9C is a vertical cross-sectional view of an embodiment of the present invention as seen from the x-y direction of FIG. 9A.
Figure 9D:
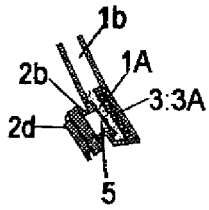
FIG. 9D is a vertical cross-sectional view of an enlarged portion of an embodiment of the present invention.
Figure 9E:
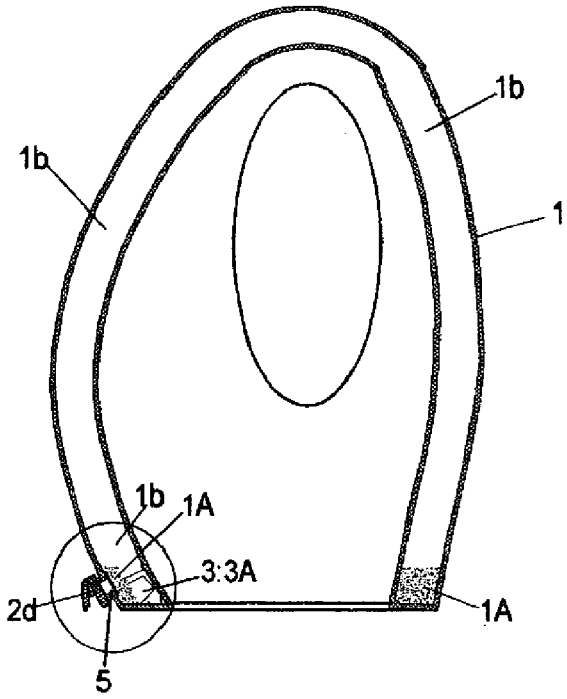
FIG. 9E is a vertical cross-sectional view of an embodiment of the present invention as seen from the x-y direction of FIG. 9A.
Figure 9F:
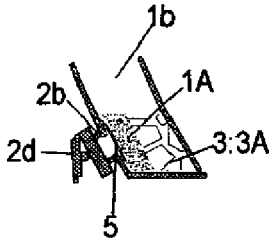
FIG. 9F is a vertical cross-sectional view of an enlarged portion of an embodiment of the present invention.
Figure 10A:
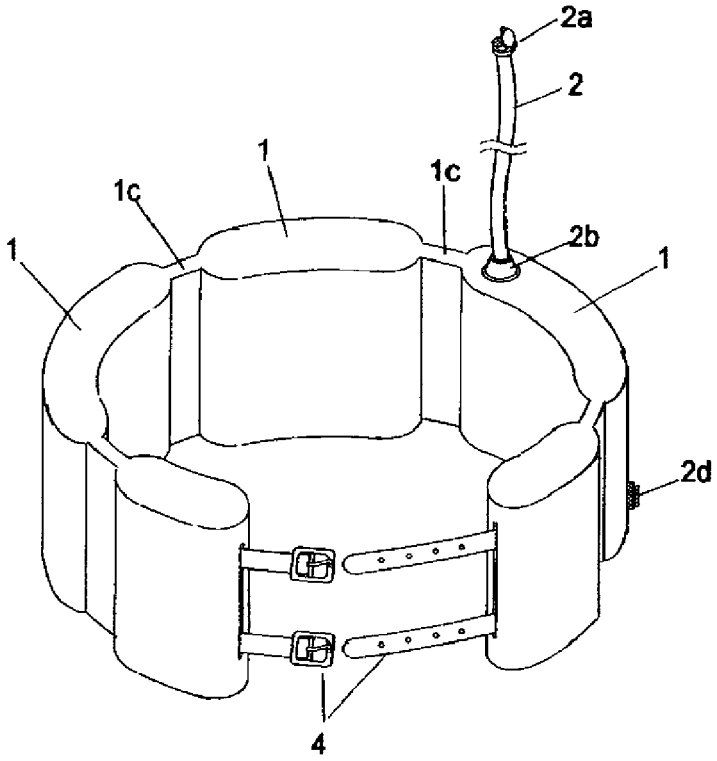
FIG. 10A is a perspective view of an embodiment of the present invention.
Figure 10B:
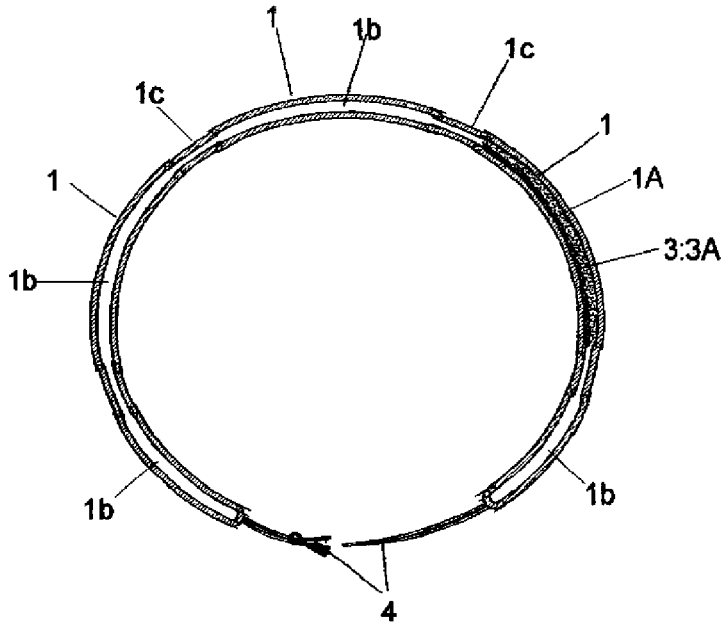
FIG. 10B is a horizontal cross-sectional view of an embodiment of the present invention.
Figure 10C:
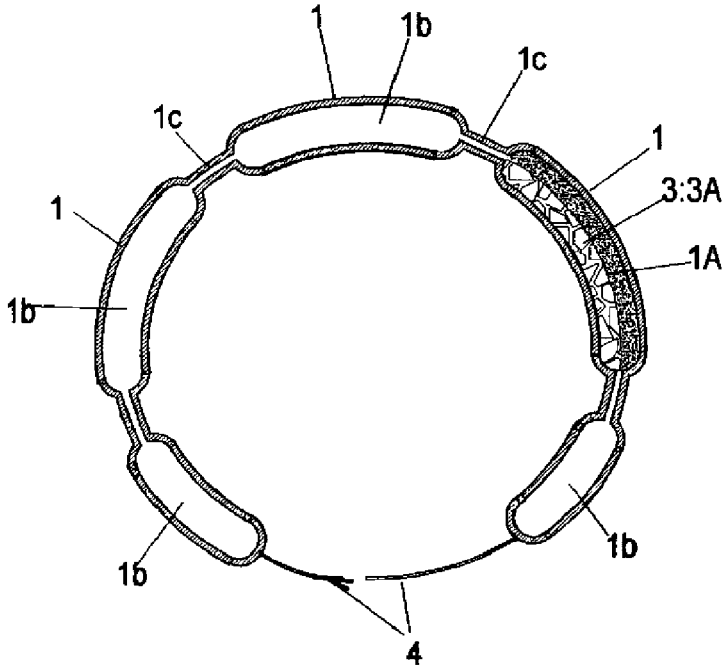
FIG. 10C is a horizontal cross-sectional view of an embodiment of the present invention.
Figure 11B:
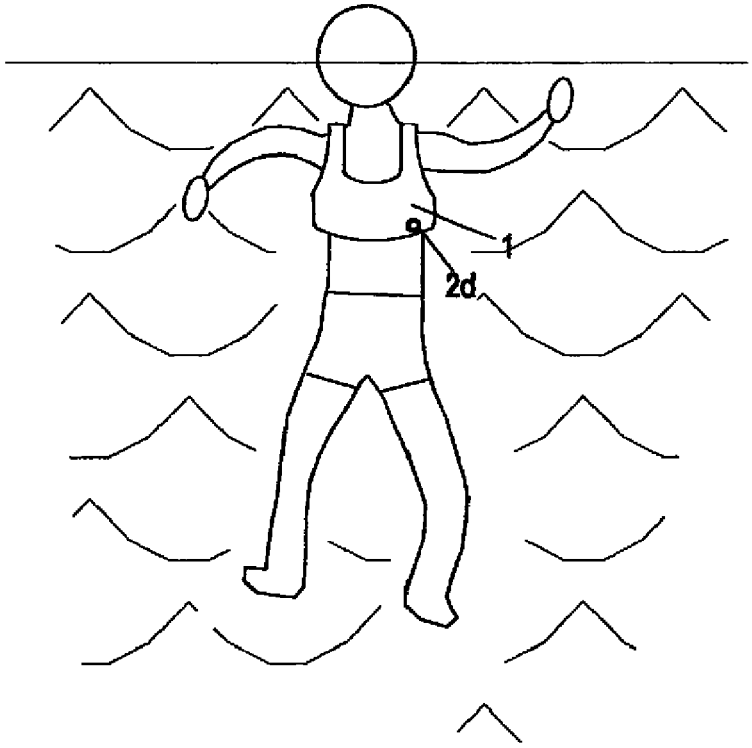
FIG. 11B is a front view of an embodiment of the present invention.

FIGS. 9A to 9F show a configuration in which the water inlet 2*d* is disposed in a lower region of the preserver body 1. A person does not remain calm when drowning, and when a person is submerged as shown in FIG. 11B, it can be difficult to operate the air inlet 2*a* or the water inlet 2*d* if these inlets are positioned at an upper portion of the preserver body 1 as in the previous embodiments. Therefore, when the water inlet 2*d* is at a lower portion of the preserver body 1 as in the present embodiment, the water inlet 2*d* can be operated (opened) in the water to expand the preserver body 1 and enable floating above the water surface. In the present embodiment, the compressed elastic member 3A fills the bottom of the hollow region 1*b* in the thin and flat state shown in FIG. 9C. The foaming portion 1A including the foaming agent is disposed together with the elastic member 3A. When the water inlet 2*d* is opened in water as shown in FIGS. 9E and 9F, the elastic member 3A expands due to the resilient force, thereby creating negative pressure within the hollow region 1*b* that causes water to be sucked in through the water inlet 2*d*. The sucked-in water permeates the foaming agent and causes a chemical reaction that generates gas (carbon dioxide gas). The generated gas (carbon dioxide gas) fills and expands the hollow region 1*b*, and therefore the entire preserver body 1 expands to achieve buoyancy and float above the water surface, in the same manner as in the previous embodiments. In this exemplary configuration, the opening of the water inlet 2*d* is provided with a filter 5 and the water passes through the filter 5 to permeate the foaming agent. This filter 5 prevents the foaming agent from leaking out from the opening of the water inlet 2*d*.

FIGS. 10A to 10C show a fourth exemplary embodiment of the present invention, in which the elastic member 3A is disposed together with the foaming portion 1A including the foaming agent within one of the preserver bodies 1 in the life preserver having the configuration shown in FIG. 4. In this configuration, the water inlet 2*d* disposed on this preserver body 1 is opened to create a chemical reaction between the water sucked in through the water inlet 2*d* and the foaming agent, in the same manner as in the previous embodiment, and the gas (carbon dioxide gas) generated by the chemical reaction fills and expands the hollow region 1*b*. Furthermore, the generated gas (carbon dioxide gas) causes each preserver body 1 in communication via the communicating holes 1*c* to expand, and therefore each preserver body 1 achieves buoyancy in the same manner as in the previous embodiment.

In the configurations described in FIGS. 7A to 7G, 9A to 9F, and 10A to 10C, the hollow region 1*b* is not filled by the elastic member 3A, but each embodiment may instead completely fill the hollow region 1*b* with the elastic member 3A, or may fill the hollow region 1*b* with a suitable amount of the elastic member 3A. Furthermore, a suitable amount of a chemical component (such as aluminum powder or calcium lime) that generates heat by reacting with water may be included in the hollow region 1*b*. The preserver body 1, blow tube 2, air inlet 2*a*, and water inlet 2*d* in each embodiment can be formed by a resin such as vinyl chloride. The life preserver of the present invention provides thermal insulation, and therefore can be worn as clothing for warmth, in addition to having the life-saving benefits. Furthermore, the life preserver can be formed as a vest, whit a zipper that opens and closes the front, for example. Instead of the being open and closed by a lid, as shown in FIGS. 3A and 3B, the air inlet 2*a* and the water inlet 2*d* may be opened by forcibly tearing the tips thereof. The foaming agent that generates the gas (carbon dioxide gas) as a result of chemically reacting with water or sea water may include sodium hydrogen carbonate and tartaric acid as a primary component, or citric acid and baking soda can be separated and then mixed with the sucked-in water to cause a chemical reaction and generate gas. In each embodiment, it is not necessary that the blow tube 2 be included, and instead the air inlet 2*a* may be provided to suck air directly into the hollow region 1*b* and the water inlet 2*d* may be provided to suck water or sea water directly into the hollow region 1*b*. With this configuration as well, the inlets can be implemented at suitable positions such that the sucked-in water or sea water flows over the foaming agent of the foaming portion 1A, in order for the resilient force of the resilient component 3 to be active.

Figure 12:
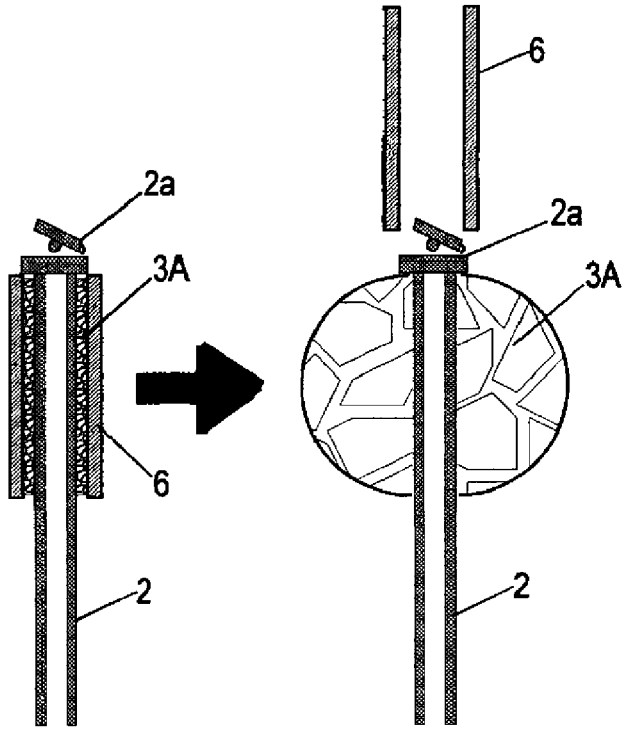
FIG. 12 is a vertical cross-sectional view of an enlarged portion of an embodiment of the present invention.

FIG. 12 shows an example in which the air inlet 2*a* sucks in air without being immersed in water. Since a drowning person is not calm, is can be difficult for this person to reliably raise the air inlet 2*a* above the water surface. Therefore, this configuration guarantees that the air inlet 2*a* will be above the water surface even if the air inlet 2*a* is opened under water, and therefore an elastic member 3A that does not suck in water is disposed with a suitable size around the blow tube 2, as shown in the drawings. The elastic member 3A is stored in a compressed state within a cylinder 6, and when the cylinder 6 is lifted up in an emergency to release the elastic member 3A from within the cylinder 6, such that the elastic member 3 returns to the its original spherical size due to the resilient force. At this point, the elastic member 3A exhibits buoyancy and floats above the water surface, and therefore the air inlet 2*a* is kept above the water surface and is able to suck in air. The air inlet 2*a* may be configured to open at the same time that the operation is performed to pull the cylinder 6 upward.

Figure 14A:
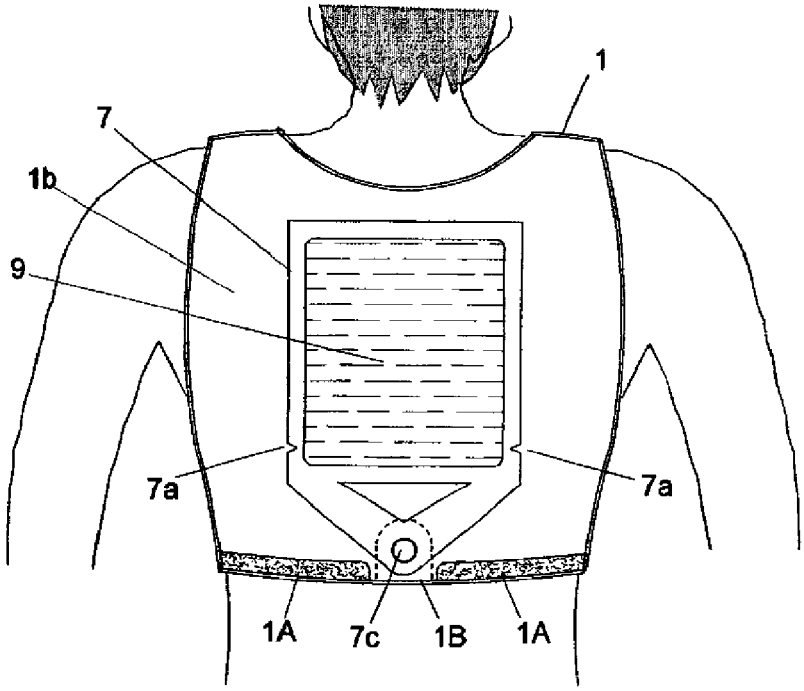
FIG. 14A is a transparent front view of an embodiment of the present invention.
Figure 14B:
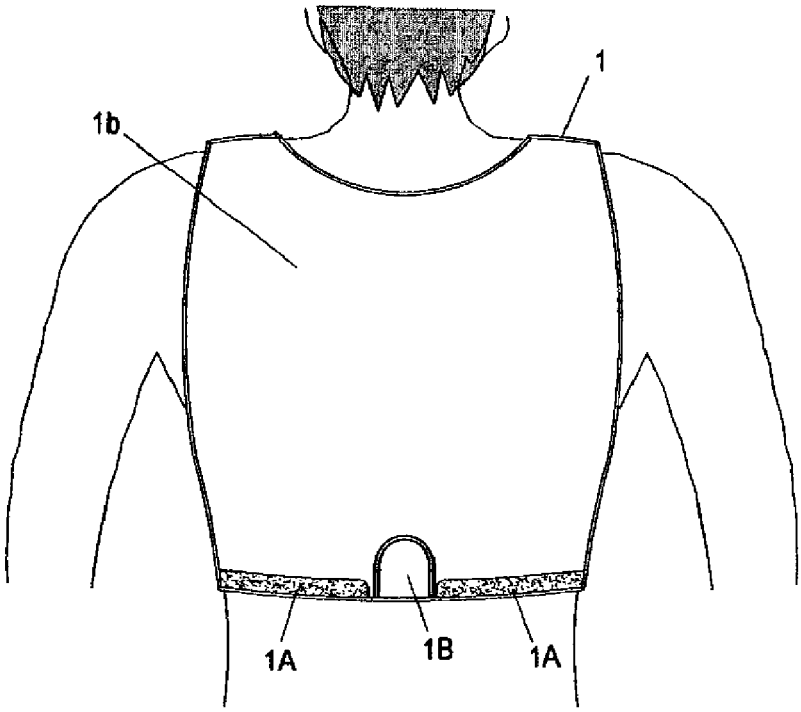
FIG. 14B is a transparent front view of an embodiment of the present invention.
Figure 14C:
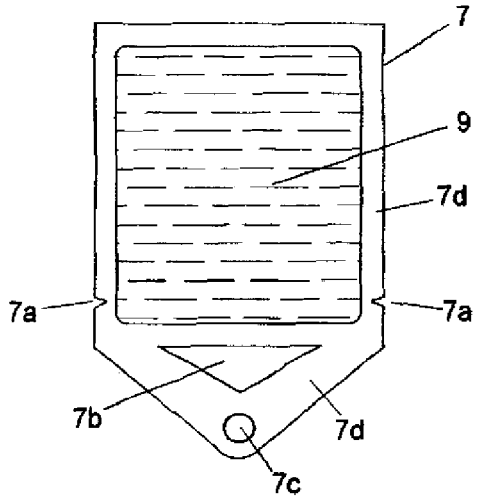
FIG. 14C is a front view of a portion of an embodiment of the present invention.
Figure 14D:
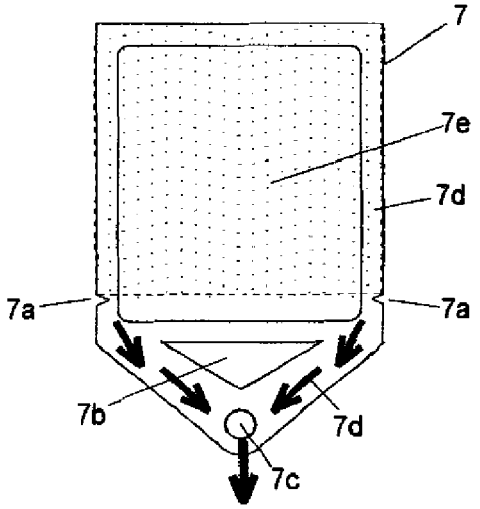
FIG. 14D is a front view of a portion of an embodiment of the present invention.
Figure 15A:
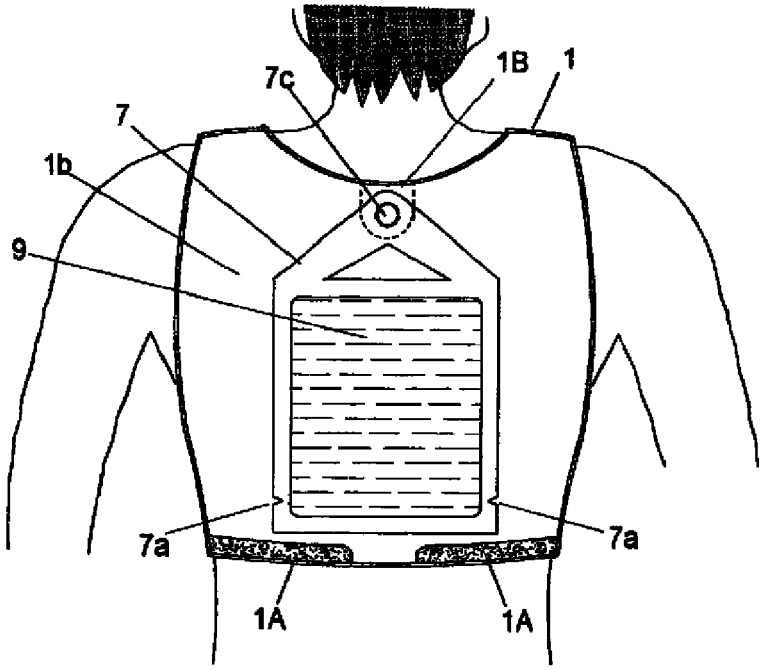
FIG. 15A is a transparent front view of an embodiment of the present invention.
Figure 15B:
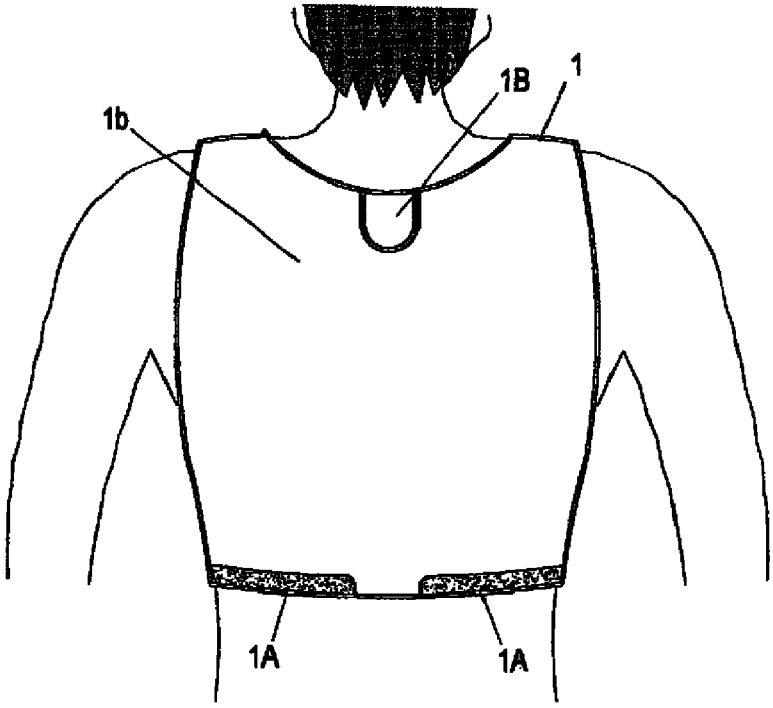
FIG. 15B is a transparent front view of an embodiment of the present invention.
Figure 15C:
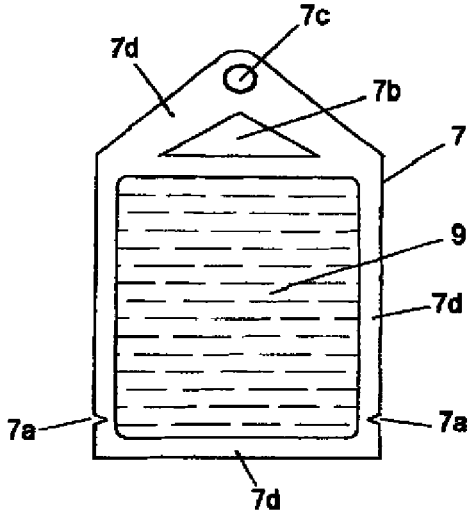
FIG. 15C is a front view of a portion of an embodiment of the present invention.
Figure 15D:
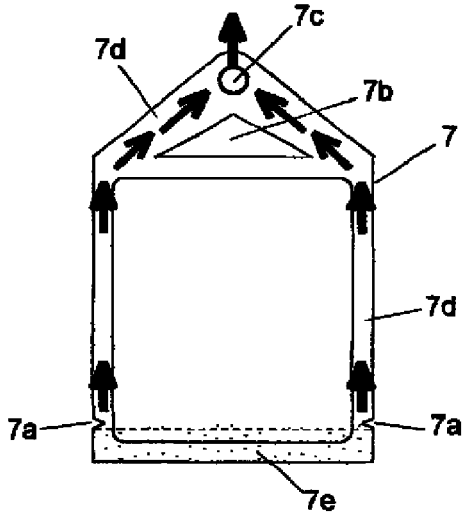
FIG. 15D is a front view of a portion of an embodiment of the present invention.
Figure 16A:
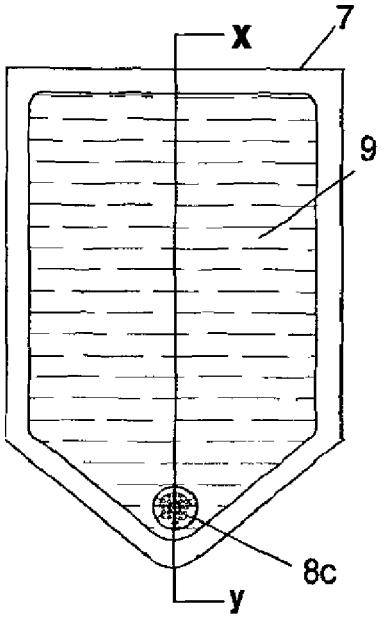
FIG. 16A is a front view of an embodiment of the present invention.
Figure 16B:
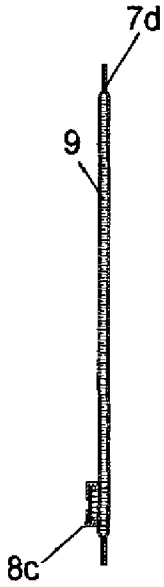
FIG. 16B is a vertical cross-sectional view of an embodiment of the present invention as seen from the x-y direction of FIG. 16A.
Figure 18A:
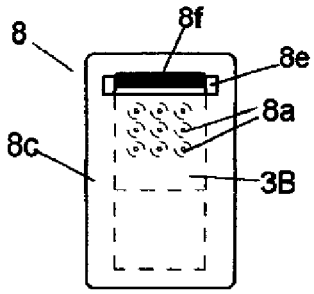
FIG. 18A is a front view of a portion of an embodiment of the present invention.
Figure 18B:
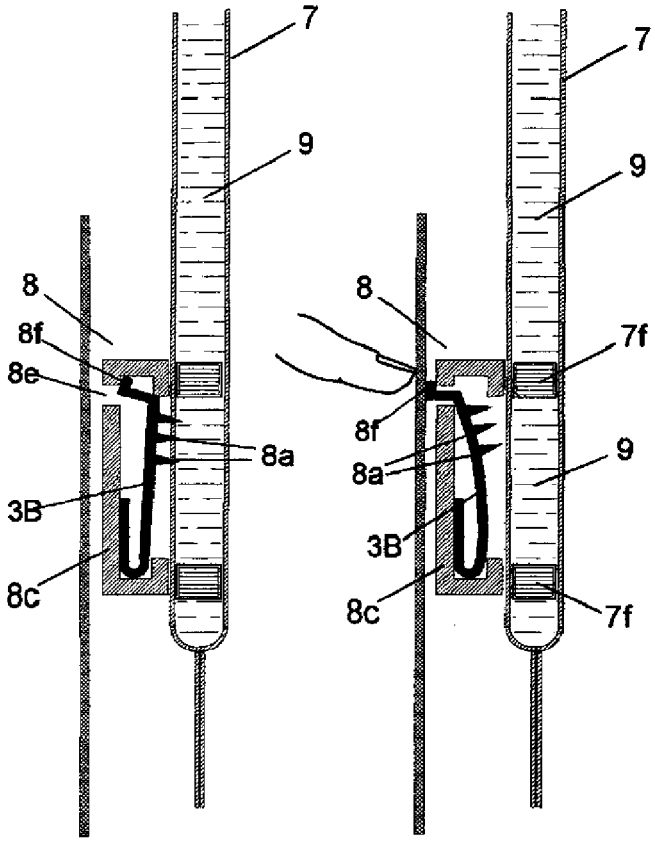
FIG. 18B is a vertical cross-sectional view of a portion of an embodiment of the present invention.
Figure 18C:
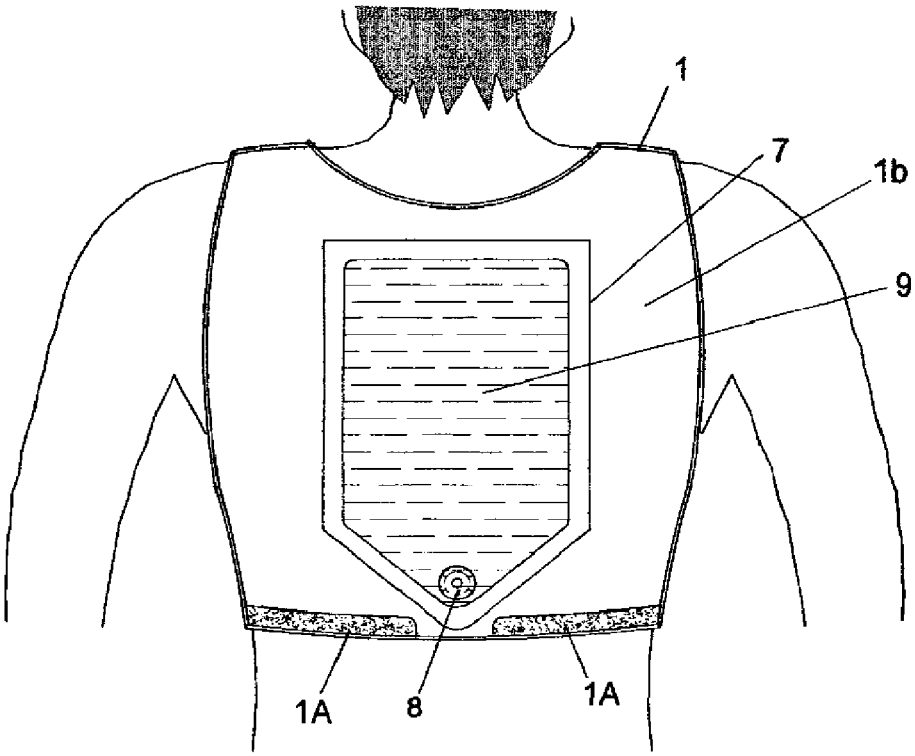
FIG. 18C is a transparent front view of an embodiment of the present invention.

Among the configurations of the embodiments shown in FIGS. 14A to 18C, FIGS. 14A to 15D show a fifth embodiment of the present invention, FIGS. 16A to 17 E show a sixth embodiment of the present invention, and FIGS. 18A to 18C show a seventh embodiment of the present invention. In each of these embodiments, the preserver body 1 expands according to an operation from outside the preserver body 1 to achieve buoyancy, in the same manner as in the previous embodiments.

As shown by FIG. 14B, the hollow region 1*b* is formed within the preserver body 1 in a sealed state, in the same manner as in the previous embodiments. The foaming portion 1A including the foaming agent that generates the gas by reacting with a liquid is disposed at the bottom of the preserver body 1, as shown in the drawings. The foaming portion 1A may be provided with the foaming agent exposed, or the foaming agent may be wrapped in a cloth, gauze, or paper that is dissolved by the liquid, for example. The foaming agent may be wrapped in a water-soluble material 11, which is described further below. Next, a pocket 1B with a recessed shape is formed at the center of the bottom of the preserver body 1, as shown in the drawings. The pocket 1B may be shaped as a recessed portion at the bottom center of the preserver body 1, or may be formed as a protruding tongue that protrudes into the preserver body 1. The following describes the liquid bag 7 disposed in the preserver body 1, using FIGS. 14C and 14D. The liquid bag 7 is formed of polyethylene or the like and, as shown in FIG. 14C, seals in a reactive liquid 9 that reacts with the foaming agent to generate gas. A bonded portion 7*d* that is bonded by thermo-compression is formed on the edges of the liquid bag 7. In this state, the reactive liquid 9 is sealed within the liquid bag 7 and does not leak out. Next, wedge-shaped notches 7*a* are formed at both edges of the bonded portion 7*d* of the liquid bag 7, as shown in the drawings, an opening 7*b* is formed as a triangular opening, and a pulling hole 7*c* is formed as a circular opening. As shown in FIG. 14A, the liquid bag 7 is fixed within the preserver body 1, the pulling hole 7*c* formed at the bottom of the liquid bag 7 protrudes within the pocket 1B, and the preserver body 1 is in a sealed state. The method for fixing the liquid bag 7 within the preserver body 1 includes forming an affixing portion 7*e* over the entire back surface of the portion above the notches 7*a*, as shown in FIG. 14D, and affixing the affixing portion to the inner surface of the preserver body 1. In the state shown in FIG. 14A, when the pointer finger is inserted in the pulling hole protruding in the pocket 1B and pulled downward, the force of the finger pulling down on the pulling hole 7*c* is focused on the right and left portions of the bonded portion 7*d* formed at the edges of the liquid bag 7, as shown by the arrows in FIG. 14D. As a result, since the back surface above the notches 7*a* is affixed to the inner surface of the preserver body 1, the downward pulling force is mainly added to the notches 7*a*. Therefore, the liquid bag 7 is torn at the wedge-shaped notches 7*a*, so that the reactive liquid 9 within the liquid bag 7 is released. The released reactive liquid 9 flows downward due to gravity and mixes with the foaming agent of the foaming portion 1A to cause a chemical reaction and begin generating gas. The generated gas fills the hollow region 1*b* of the preserver body 1, causing the preserver body 1 to obtain buoyancy in the water due to the generated gas.

The inventor of the present invention performed an experiment with a bag made of polyethylene with a thickness of 0.08 mm, and a bag made of resin is considerably strong in the pulling direction and does not tear even when a large pulling force is applied. In contrast, the strength of this bag in the tearing direction is fairly low, and therefore the bag can be torn in the tearing direction with a small pulling force. Therefore, the liquid bag 7 can be easily torn if the pulling hole 7*c* is pulled downward in the state shown in FIG. 14A. As a result, the reactive liquid 9 sealed in the liquid bag 7 is immediately released and causes a chemical reaction with the foaming agent, thereby achieving buoyancy for the preserver body 1*a* few seconds later due to the generated gas. The pulling hole 7*c* being operated is hidden within the pocket 1B, and therefore the preserver body 1 does not expand unless a finger is intentionally inserted within the pocket 1B and the pulling hole 7*c* is pulled. With the configuration of FIG. 14A, the generated gas rises and collects at the top even if the pocket 1B is not sealed, and therefore buoyancy can be achieved. However, in order to prevent gas from leaking out of the preserver body 1, the pocket 1B is preferably completely sealed.

FIGS. 15A to 15D show a configuration of an exemplary embodiment that can be operated from the top edge of the preserver body 1. As shown in FIG. 15B, the foaming portion 1A is formed at the bottom of the preserver body 1, and the pocket 1B, which is the same as in the previous embodiment, is formed at the top edge of the preserver body 1. Next, as shown in FIG. 15C, the reactive liquid 9 is sealed in the liquid bag 7 and the edges thereof are bonded to form the bonded portion 7*d*. Wedge-shaped notches 7*a* are formed at both edges in a lower portion of the bonded portion 7*d* of the liquid bag 7, a opening 7*b* is formed as a triangular opening in the upper portion of the liquid bag 7, and a pulling hole 7*c* is formed as a circular opening. As shown in FIG. 15D, an affixing portion 7*e* is formed over the entire back surface of the portion below the notches 7*a*, and the liquid bag 7 is affixed by the affixing portion to the inner surface of the preserver body 1, as shown in FIG. 15A. In this state, when the pointer finger is inserted in the pulling hole and pulled upward, the force of the finger pulling up on the pulling hole 7*c* is applied as shown by the arrows in FIG. 15D. As a result, the liquid bag 7 is torn at the wedge-shaped notches 7*a*, so that the reactive liquid 9 is released to cause a chemical reaction with the foaming agent and begin generating gas, in the same manner as the previous embodiment, thereby causing the preserver body 1 to obtain buoyancy.

In the configurations shown in FIGS. 14A to 15D, the pulling force from outside the preserver body 1 is added to a prescribed portion of the liquid bag 7 within the preserver body 1 to rip the liquid bag 7 at the prescribed portion. Instead of the notches 7*a* shown in these embodiments, the portion to be ripped may be a perforated line or the like formed on the liquid bag 7. By forming an easily ripped prescribed portion in the liquid bag 7 using notches or a perforated line in this way, the pulling force from outside the preserver body 1 is focused at the prescribed portion to achieve the ripping operation. As a result, the liquid bag 7 can be easily ripped by the pulling force from outside the preserver body 1.

FIGS. 16A to 17E show configurations of exemplary embodiments in which the operation for tearing the liquid bag 7 is achieved by a pressing operation from outside the preserver body 1.

Figure 16C:
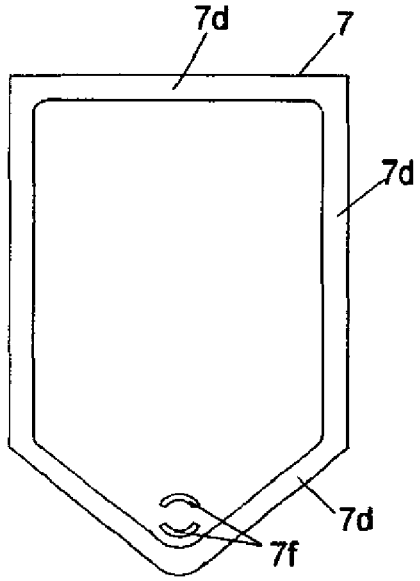
FIG. 16C is a front view of an embodiment of the present invention.
Figure 16D:
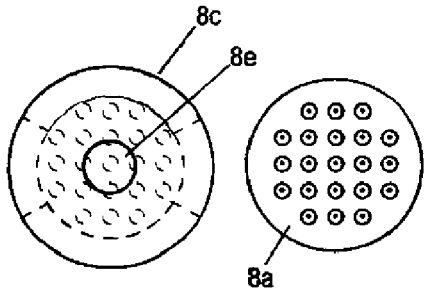
FIG. 16D is a front view of an embodiment of the present invention.
Figure 16E:
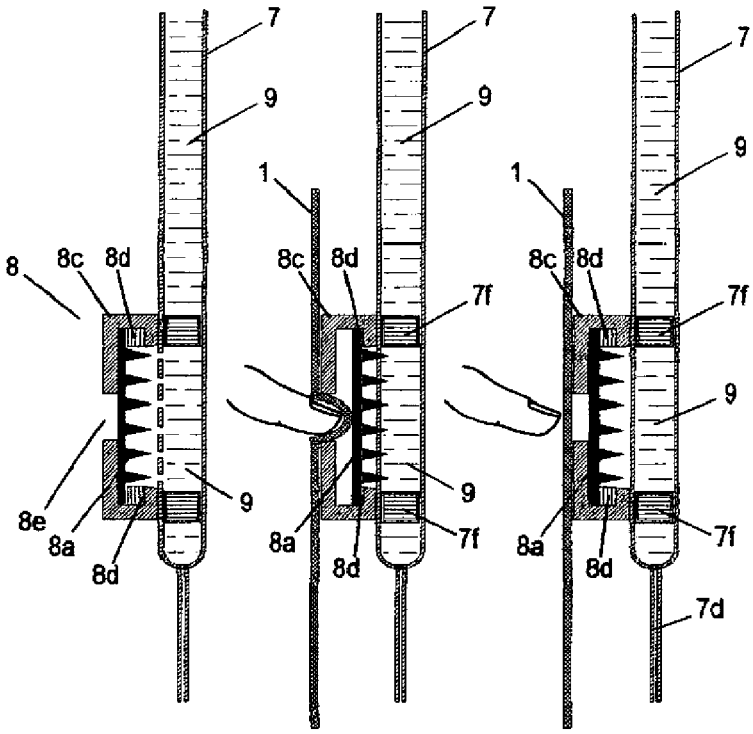
FIG. 16E is a vertical cross-sectional view of a portion of an embodiment of the present invention.
Figure 17A:
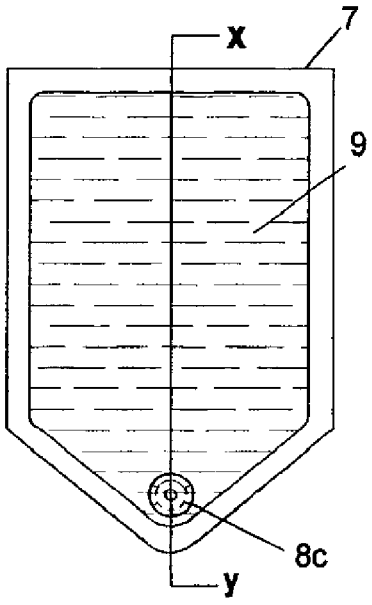
FIG. 17A is a front view of an embodiment of the present invention.
Figure 17B:
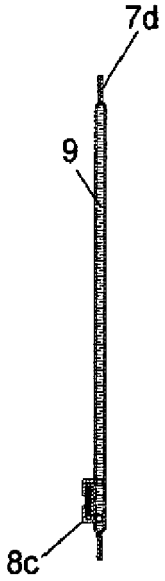
FIG. 17B is a vertical cross-sectional view of an embodiment of the present invention as seen from the x-y direction of FIG. 16A.
Figure 17C:
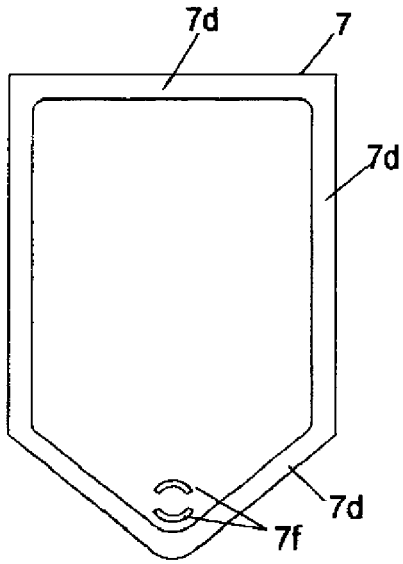
FIG. 17C is a front view of an embodiment of the present invention.
Figure 17D:
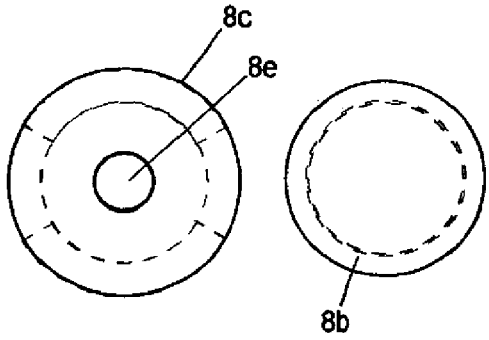
FIG. 17D is a front view of an embodiment of the present invention.
Figure 17E:
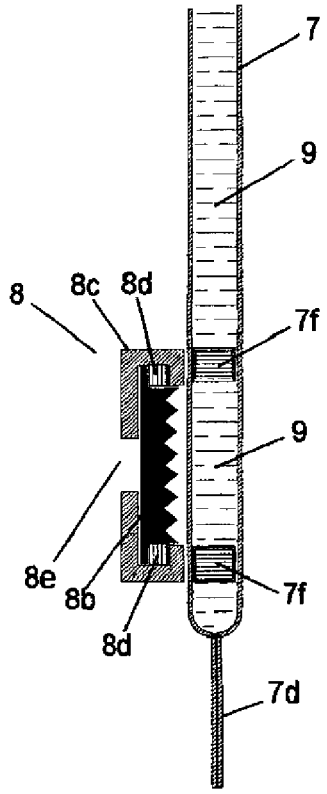
FIG. 17E is a vertical cross-sectional view of a portion of an embodiment of the present invention.

As shown in FIG. 16C, interposed boards 7*f* formed as opposing arcs with suitable thickness at the bottom region within the liquid bag 7 are affixed to the inner surface of the liquid bag 7 (or to the outer surface of the liquid bag 7). In this state, the surface of the liquid bag 7 between the interposed boards 7*f* is held in a stretched state. The reactive liquid 9 sealed within the liquid bag 7 can flow freely between the interposed boards 7*f*. Next, as shown in FIGS. 16D and 16E, an operating portion 8 that is operated outside the sealed liquid bag 7 is provided at a position that overlaps the interposed boards 7*f*, and the operating portion 8 forms a chassis 8*c* that is open at both sides and includes a circular operation hole 8*e* in the center thereof. A resilient portion 8*d* having elasticity and a needle portion 8*a* including one or more needles having sharpened points formed on a disc above the resilient portion 8*d* are disposed in the chassis 8*c*. Next, the liquid bag 7 including the operating portion 8 is affixed within the preserver body 1, as shown in FIG. 18C. In this state, the actual liquid bag 7 tearing operation is performed as shown in FIG. 18E. First, the position of the operation hole 8*e* in the center of the chassis 8*c* is found by the pointer finger from outside the preserver body 1, and when this position is pressed hard by the pointer finger, the resulting force causes the surface contact the preserver body 1 to be depressed, thereby pressing the needle portion 8*a* inward. Next, the needles formed on the needle portion 8*a* puncture the portion of the preserver body 1 that is contacted, creating holes. When the pointer finger is removed, the needle portion 8*a* returns to the original position due to the elastic force of the resilient portion 8*d*, so that the reactive liquid 9 is released from the preserver body 1 through the opened holes and chemically reacts with the foaming agent of the foaming portion 1A to begin generating gas. As a result, the preserver body 1 is filled with the generated gas and the preserver body 1 achieves buoyancy, in the same manner as in the previous embodiments.

FIGS. 17A to 17E show a configuration in which the needle portion 8*a* of the operating portion 8 in FIGS. 16A to 16E is replaced by a cutter portion 8*b* in which a blade with a ring of protrusions having sharpened tips are formed on a disc. With this configuration, in the same manner as in the previous embodiment, when the operation hole 8*e* is pressed hard by the pointer finger, the cutter portion 8*b* is pressed inward, which causes the liquid bag 7 to be torn by the ring of protruding blades. In this case, a circular hole can be formed in the liquid bag 7, and the reactive liquid 9 released from this hole chemically reacts with the foaming agent of the foaming portion 1A to begin generating gas, thereby achieving buoyancy for the preserver body 1 in the same manner.

In the configurations of FIGS. 16A to 17E, a pressing force is added perpendicular to a stretched surface of the liquid bag 7 by needles or blades formed with sharpened tips. The force in the pressing direction creates a wedging effect that expands the openings of the surface. Therefore, even if the blades or needles are not moved laterally after penetrating the surface of the liquid bag 7, large holes can be opened in the liquid bag 7 simply by adding force in a perpendicular direction for pressing the bag surface. With this operation, unless a finger is inserted into the operation hole 8*e* portion and intentionally presses down, the liquid bag 7 is not torn.

FIGS. 18A to 18C show an exemplary embodiment in which a latch structure is disposed in the operating portion 8, and in which operating the bias member 3B, which is set in the latched state in advance, from outside the preserver body 1 to release the bias member 3B from the latched state, the resilient force returning the bias member 3B to the original shape serves to tear the liquid bag 7. The bias member 3B formed by a flat spring is disposed in the chassis 8*c* while bent with a strong force, as shown in the drawings, and a operation hook 8*f* bent to the outside is formed at the top of the bias member 3B. The operation hook 8*f* protrudes from the operation hole 8*e*, and the bent end thereof is set to the latched state as shown in the drawings. In this state, the needle portion 8*a* formed on the bias member 3B does not contact the liquid bag 7. During an emergency or when necessary, when the operation hook 8*f* is pressed from above the preserver body 1 by a finger, the operation hook 8*f* is released from the latched state and the bias member 3B changes from the loaded state to the unloaded state. Therefore, the operation hook 8*f* is pulled into the operation hole 8*e* by the resilient force of the bias member 3B, and at the same time the needle portion 8*a* formed on the bias member 3B pierces and tears the liquid bag 7. The reactive liquid 9 in the torn liquid bag 7 is gradually released. The reactive liquid 9 gradually flows from through the opened sides of the chassis 8*c* downward into the preserver body 1, and chemically reacts with the foaming agent of the foaming portion 1B to generate gas. Since a person is not calm during an emergency, the liquid bag 7 is preferably torn open with as simple an operation as possible, and the configuration of the present embodiment simplifies this operation. The present embodiment shows an exemplary latch structure realized by a flat spring, but the properties of a bias member other than a flat spring, i.e. the ability to deform when pressure is added and return to an original shape when the pressure is removed, can be used to create any structure that can be set in a latched state in advance and released from the latched state during an emergency or when necessary to tear the liquid bag 7. Furthermore, the cutter portion 8*b* may be used instead of the needle portion 8*a* to tear the liquid bag 7. In order for the operation hook 8*f* to not operate incorrectly, an enclosure, not shown, with a suitable size may be formed around the operation hook 8*f*.

Figure 19A:
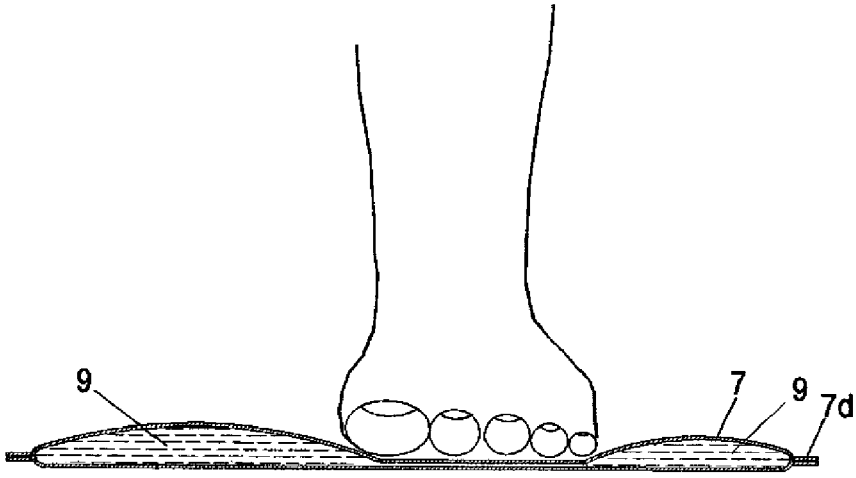
FIG. 19A is a vertical cross-sectional view of a portion of an embodiment of the present invention.
Figure 19B:
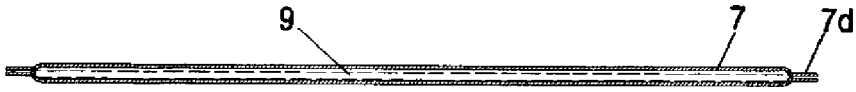
FIG. 19B is a vertical cross-sectional view of a portion of an embodiment of the present invention.
Figure 19C:
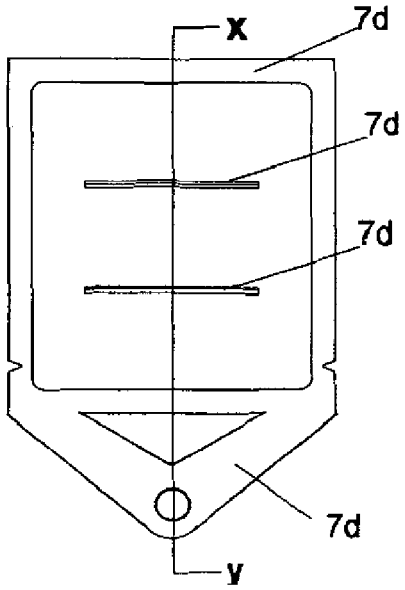
FIG. 19C is a front view of a portion of an embodiment of the present invention.
Figure 19D:
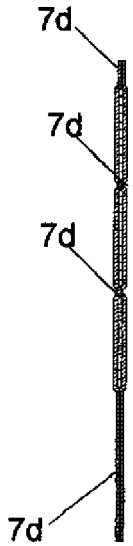
FIG. 19D is a vertical cross-sectional view of an embodiment of the present invention as seen from the x-y direction of FIG. 19C.

FIGS. 19A to 19D show a configuration of an exemplary embodiment a liquid bag 7. When the reactive liquid 9 sealed in the liquid bag 7 occupies 80% to 100% of the liquid bag 7 and the liquid bag 7 is stepped on as shown in FIG. 19A, there is a concern that the liquid bag 7 will be ripped. Therefore, the liquid bag 7 is filled with the reactive liquid 9 up to 40% to 60% such that the liquid bag 7 remains thin and flat. As a result, even if the liquid bag 7 is stepped on, the reactive liquid 9 within the liquid bag 7 flows around the foot and does not add pressure to the inside of the liquid bag 7, and therefore the liquid bag 7 is not ripped. In this case, by increasing the size of the liquid bag 7, enough reactive liquid 9 can be sealed in the liquid bag 7 to achieve buoyancy. Furthermore, to prevent the reactive liquid 9 sealed in the liquid bag 7 from being distributed unevenly due to gravity, the bonded portion 7*d* bonding the inner surfaces of the liquid bag 7 to each other is formed at suitable locations, as shown in FIG. 19C.

The liquid bag 7 of the present invention may be formed by a suitable resin other than polyethylene, and can be formed of any material that is strong with respect to pulling and weak with respect to tearing. In the embodiments shown in FIGS. 14A to 19D, the elastic member 3A may be disposed in the preserver body 1 in a compressed state and expand according to the gas generated in the preserver body 1, in the same manner as in the previous embodiments. As another example, the elastic member 3A may be provided in an uncompressed state within the preserver body 1. Each embodiment may include a configuration in which the reactive liquid 9 chemically reacts with the foaming agent of the foaming portion 1A to generate gas. For example, the reactive liquid 9 may be sterile water and the foaming agent in the previous embodiments that generates gas by chemically reacting with water or sea water may be manganese dioxide, which is a catalyst for the reactive liquid with hydrogen peroxide, such that the generated gas is oxygen. Therefore, when a person is drowning and lacks oxygen, the person can breathe the gas generated in the preserver body 1. In the configurations of FIGS. 14A to 15D, a strap or the like may be connected to the liquid bag 7 in advance, such that the liquid bag 7 can be torn by pulling the strap. As another example, a needle or blade that tears the liquid bag 7 when the strap is pulled may be provided, such that the needle or blade is brought into contact with the liquid bag 7 to tear the liquid bag 7. As another exemplary configuration, the pocket 1B may be disposed on a side of the preserver body 1, and the liquid bag 7 oriented sideways in the liquid bag 7 can be torn by being pulled sideways.

In the exemplary embodiments shown in FIGS. 20A to 21D, a sufficient reaction occurs between the foaming agent of the foaming portion 1A within the hollow region 1*b* of the preserver body 1 and water sucked into the hollow region 1*b* of the preserver body 1, in order to sufficiently expand the overall preserver body 1. In the embodiments shown in FIGS. 7A to 10C, when the water inlet 2*d* is opened, the resilient force of the resilient member 3 (elastic member 3A or bias member 3B) causes water to be sucked into the hollow region 1*b* of the preserver body 1, and the sucked-in water quickly reacts with the foaming agent of the foaming portion 1A to begin generating gas. Therefore, the negative pressure state of the hollow region 1*b* of the preserver body 1 is eliminated not only by the sucked-in water, but also by the generated gas. Therefore, it is necessary to suck in a large amount of water all at once into the hollow region 1*b* of the preserver body 1. In this case, it is difficult to set the relationship with respect to the resilient deformation speed of the resilient member 3 (elastic member 3A or bias member 3B). The embodiments shown in FIGS. 20A to 21D include an amount of foaming agent sufficient to expand the entire preserver body 1 within the hollow region 1*b* of the preserver body 1. After a suitable amount of water is sucked into the hollow region 1*b* of the preserver body 1, the sucked-in water begins reacting with the foaming agent. The following provides a detailed description of the configuration for each embodiment.

Figure 20A:
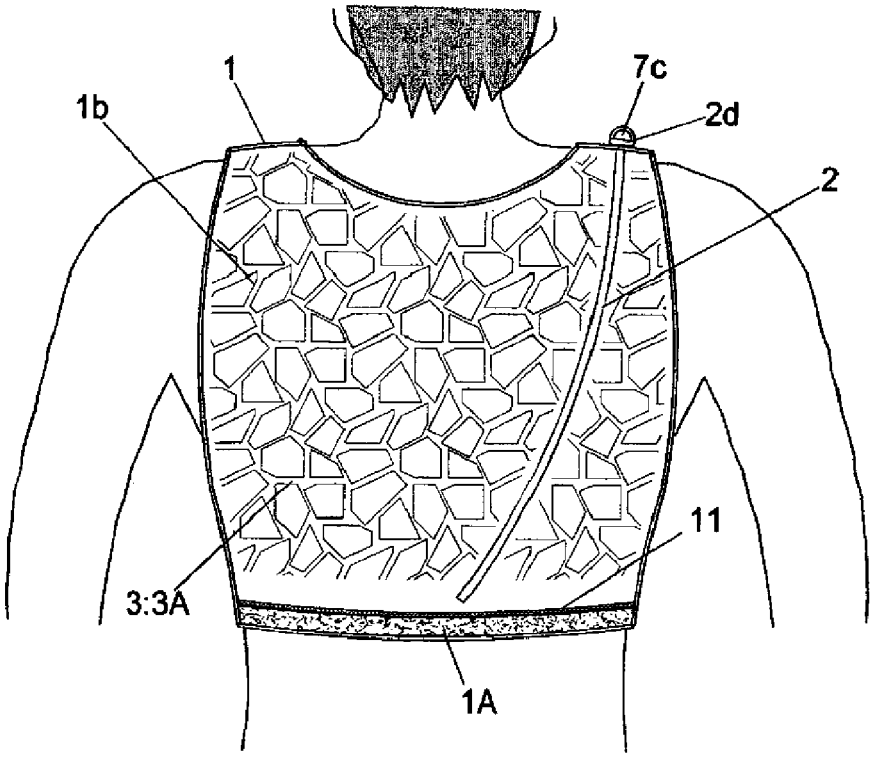
FIG. 20A is a transparent front view of an embodiment of the present invention.
Figure 20B:
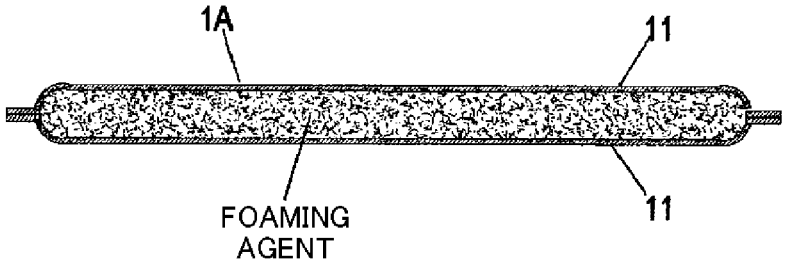
FIG. 20B is a vertical cross-sectional view of a portion of an embodiment of the present invention.
Figure 20C:
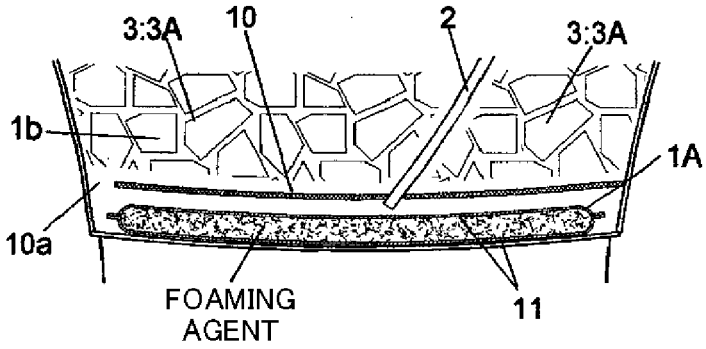
FIG. 20C is a vertical cross-sectional view of an enlarged portion of an embodiment of the present invention.

In FIGS. 20A to 20D, the hollow region 1*b* of the preserver body 1 is filled with the elastic member 3A, which may be a sponge or melamine foam, for example, the entire preserver body 1 is pressed by a press machine or the like to sufficiently compress the elastic member 3A and remove the air from the hollow region 1*b* of the preserver body 1, and then the water inlet 2*d* is closed to be in a sealed state. In this state, even if the pressure of the pressing is removed from the entire preserver body 1, the preserver body 1 remains in a compressed flat and thin state without containing air. An amount of foaming agent for sufficiently expanding the entire preserver body 1 is disposed in advance at the bottom of the preserver body 1, and the foaming portion 1A is formed by covering the entire top of the foaming agent with the water-soluble material 11 that dissolves in water. In this state, as shown in the drawings, when a person wearing the preserver body 1 formed as a vest is in danger of drowning and inserts a finger into the pulling hole 7*c* and pulls strongly, the force of the pulling causes the water inlet 2*d* to open, and at the same time the resilient force of the elastic member 3A in the preserver body 1 acts to return the elastic member 3A to the original shape. During the deformation of the return to the original shape, water is sucked in through the water inlet 2*d*, and this water flows through the blow tube 2 and over the foaming portion 1A. The sucked-in water is gradually accumulated. During the accumulation, since the foaming agent is covered by the water-soluble material 11, the sucked-in water does not immediately react with the foaming agent, and the reaction begins only after the water-soluble material 11 has been dissolved by the sucked-in water. Therefore, the inside of the hollow region 1*b* of the preserver body 1 remains in a negative pressure state until the water-soluble material 11 is dissolved, and during this time the amount of water necessary for the reaction can be sucked into the hollow region 1*b* of the preserver body 1. Therefore, an amount of foaming agent sufficient to expand the entire preserver body 1 is disposed in advance in the hollow region 1*b* of the preserver body 1, and when a suitable amount of water is then sucked in and reacts with the foaming agent, the entire preserver body 1 is sufficiently expanded to achieve sufficient buoyancy. The setting for how much time the reaction between the foaming agent and the sucked-in water is actually delayed by can be determined by the thickness and the material of the water-soluble material 11. By forming the foaming agent as a powder, gas is generated all at once when the reaction between the powdered foaming agent and the sucked-in water begins, and therefore the entire preserver body 1 can be expanded quickly. The material for forming the water-soluble material 11 that dissolves in water can be a material that reacts to water by dissolving, such as a vegetable polysaccharide water-soluble film made of starch from potatoes or sweet potatoes, such as oblaat, a water-soluble film having polyvinyl alcohol (PVA) as a primary component, or a water-soluble plastic film made of poval resin. In the configuration of FIG. 20A, a suitable gap is left between the foaming agent 1A and the elastic member 3A filling the hollow region 1*b* of the preserver body 1, such that a sufficient amount of water can be accumulated therebetween. Furthermore, the bottom surface of the elastic member 3A may be covered with a material that is not saturated by water, such that the sucked-in water is not absorbed by the elastic member 3A. FIG. 20B shows an exemplary embodiment of actual implementation of the foaming portion 1A. The foaming agent fills the water-soluble material 11, which is a water-soluble film, like a sausage, and the foaming portion 1A containing the foaming agent is provided as-is in the hollow region 1*b* of the preserver body 1, thereby realizing the present invention easily. With this configuration, manufacturing is extremely simple, safe, and reliable. The preserver body 1 may be made of a material that does not let moisture pass through, and/or a drying agent may be disposed within the preserver body 1. FIG. 20C shows a configuration for safer and more reliable implementation. A reservoir 10 is disposed at the bottom of the hollow region 1*b* of the preserver body 1, as shown in the drawings, and the foaming portion 1A shown in FIG. 20B is disposed in the reservoir 10. With this configuration, when the compressed elastic member 3A returns to the original form, the air in the reservoir 10 is sucked into the hollow region 1*b* of the preserver body 1 through a vent hole 10*a*, and at the same time water begins to be sucked in through the water inlet 2*d*. This water flows through the blow tube 2 into the reservoir 10. When this water finally dissolves the water-soluble material 11, the water begins to react with the foaming agent to generate gas. The generated gas passes through the vent hole 10*a* to fill the hollow region 1*b* of the preserver body 1, so that the entire preserver body 1 can be expanded by the generated gas. With the configuration of FIG. 20C, the sucked-in water is reliably accumulated in the reservoir 10 and reliably reacts with the foaming agent, and therefore the present invention can be safely and reliably implemented with standardized quality.

Figure 20D:
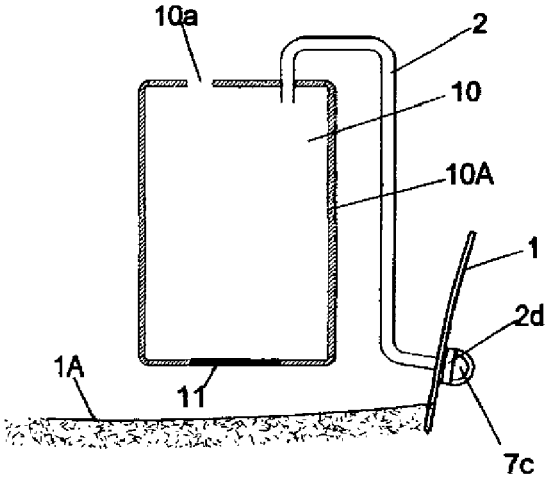
FIG. 20D is a vertical cross-sectional view of an enlarged portion of an embodiment of the present invention.
Figure 21A:
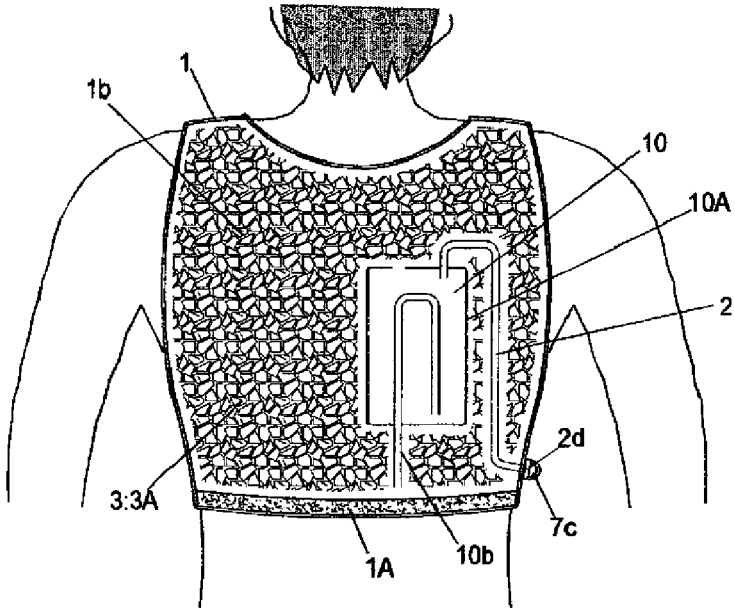
FIG. 21A is a transparent front view of an embodiment of the present invention.
Figure 21B:
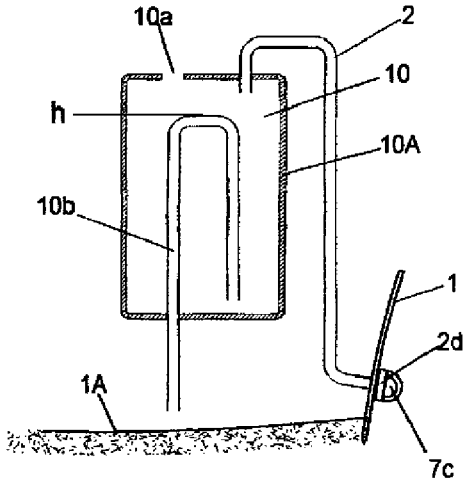
FIG. 21B is a vertical cross-sectional view of a portion of an embodiment of the present invention.
Figure 21C:
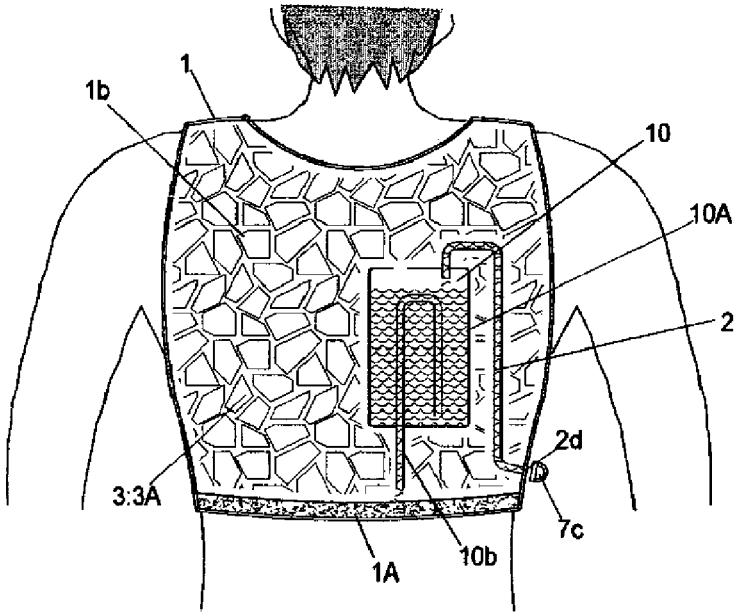
FIG. 21C is a vertical cross-sectional view of an enlarged portion of an embodiment of the present invention.
Figure 21D:
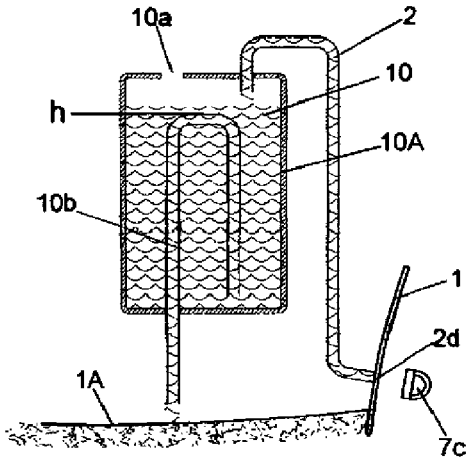
FIG. 21D is a vertical cross-sectional view of an enlarged portion of an embodiment of the present invention.

FIGS. 21A to 21D show an exemplary embodiment that achieves the same effect as the embodiment shown in FIGS. 20A to 20D. The reservoir 10 is provided to store a suitable amount of water sucked into the hollow region 1*b* of the preserver body 1. When the suitable amount of water sucked into the hollow region 1*b* of the preserver body 1 is stored, the stored water begins flowing into the hollow region 1*b* of the preserver body 1. This water flows over the foaming agent of the foaming portion 1A disposed at the bottom of the hollow region 1*b* of the preserver body 1, and creates a reaction. In the state shown in FIG. 21A, the elastic member 3A in the preserver body 1 is compressed, so that the overall preserver body 1 has a thin flat shape. In this state, the water inlet 2*d* is closed to be in the sealed state, and so water is not sucked into the hollow region 1*b* of the preserver body 1. When the person wearing the preserver body 1 is in danger of drowning and strongly pulls the on the pulling hole 7*c* with a finger while in the water, the water inlet 2*d* is opened, and at the same time the resilient force causes the elastic member 3A to return to the original shape, as shown in FIGS. 21C and 21D, during which time water begins to be sucked into the water inlet 2*d*. The sucked-in water is gradually accumulated in the reservoir container 10A after flowing through the blow tube 2, and at the same time the air in the reservoir container 10A is expelled from the vent hole 10*a*. When the water stored in the reservoir container 10A reaches a height greater than or equal to the peak h of an inverted U-shaped tube 10*b* disposed in the reservoir container 10A, the water stored in the reservoir container 10A flows into the inverted U-shaped tube 10*b*, according to the siphon principle, and begins to flow over the foaming agent of the foaming portion 1A in the hollow region 1*b* of the preserver body 1. At this time, the water sucked into the preserver body 1 begins reacting with the foaming agent to generate gas for the first time. While the gas is being generated, even though the hollow region 1*b* of the preserver body 1 has negative pressure due to the generated gas, the water in the reservoir container 10A continues to flow without being affected at all by the change of the negative pressure state, and continues flowing up to the height of the inlet of the inverted U-shaped tube 10*b*. Therefore, by including the foaming agent that sufficiently expands the entire preserver body 1 disposed in advance in the hollow region 1*b* of the preserver body 1 and the reservoir container 10A that sores a suitable amount of water for reacting with this foaming agent, the preserver body 1 can be sufficiently expanded in an emergency to reliably achieve buoyancy. For example, in a configuration where a suitable amount of water sucked in through the opened water inlet 2*d* is stored and this water flows over the foaming agent 10 to 20 seconds later to expand the preserver body 1, a person who is drowning can be saved within 10 to 20 seconds. The amount of water that is suitable for storage in the reservoir container 10A may be set as is appropriate for the size of the container, and the stored water amount can be set to determine approximately how many seconds the reaction with the foaming agent is delayed by. In the embodiments shown in FIGS. 7A to 10C, it is difficult to set the preserver body 1 to reliably achieve sufficient expansion, but with the embodiments of FIGS. 20A to 21D, the entire preserver body 1 can be reliably expanded, regardless of how many times this expansion is implemented. The reservoir container 10A can be formed of polyethylene or vinyl chloride having a suitable thickness, for example. As another example, the foaming unit 1A containing the foaming agent wrapped in the water-soluble material 11 shown in FIG. 20B can be disposed at the bottom of the hollow region 1*b* of the preserver body 1 shown in FIGS. 21A to 21D. In this case, the water-soluble material 11 can be set to dissolve in a few seconds. In the configurations shown in FIGS. 20A to 21D, a check valve may be disposed in the water inlet 2*d* to prevent reverse flow, in order to prevent the gas generated in the preserver body 1 from leaking to the outside. In the configuration shown in FIGS. 20A to 20D, disposing the water inlet 2*d* at the torso region instead of the shoulder region can more reliably ensure that water or sea water is sucked in.

As another configuration for realizing the means shown in FIGS. 20A to 21D, the bottom of the container reservoir 10A may be formed by the water-soluble material 11 that dissolves in water, as shown in FIG. 20D, or the entire reservoir container may be formed by the water-soluble material 11. When a suitable amount of water is accumulated in the reservoir container 10A, the water-soluble material 11 dissolves and the accumulated water naturally falls. As another example, a configuration can be used in which the suitable amount of water accumulated in the reservoir container 10A can automatically drop due to its own weight. Any means can be used as long as, when the suitable amount of water is sucked into the preserver body 1, the water automatically reacts with the foaming agent after a suitable time has passed.

The life preserver of the present embodiment can be worn on the body in a thin and flat state during work or swimming. In each embodiment, the preserver body 1 is operated from the outside to expand the preserver body 1 and achieve buoyancy, and therefore each embodiment has a special technical feature.

What is claimed is:

1. A life preserver that is worn on a body, comprising:

a preserver body including therein a hollow region in a sealed state;

a resilient component, provided in the hollow region, that deforms when pressure is added and returns to an original shape when pressure is withdrawn; and a foaming portion that includes a foaming agent disposed within the hollow region, wherein a water inlet enabling water or sea water to flow into the hollow region is disposed in the preserver body, and with the resilient component in a deformed state resulting from the addition of pressure, air removed from the hollow region, the water inlet held in a sealed state, and the preserver body in water, when the water inlet is opened in the water and water or sea water flows into the hollow region, with F1 representing water pressure added to the preserver body, a resilient force F2 operates on the resilient component to be greater than F1 and the resilient component changes shape in a manner to return to the original shape, and in accordance with the resilient component changing shape, water or sea water flows from the opened water inlet into the hollow region to generate a gas resulting from a chemical reaction between the foaming agent and the water or sea water to increase the total volume within the preserver body, thereby increasing buoyancy of the overall preserver body and causing the body wearing the preserver body to float.

2. The life preserver according to claim 1, wherein the life preserver can be worn as warming clothing.

3. The life preserver according to claim 1, comprising means for delaying the beginning of the chemical reaction between the foaming agent and the water or sea water.

4. The life preserver according to claim 1, comprising a plurality of the preserver bodies, wherein the hollow regions of the preserver bodies are in communication with each other via a communicating hole, and the communicating hole transfers the gas generated in at least one of the preserver bodies to each hollow region.

5. The life preserver according to claim 1, wherein the foaming agent is wrapped within a material that is dissolved by the water or sea water.

6. The life preserver according to claim 3, wherein the means for delaying allows for a prescribed amount of water or sea water to flow into the preserver body.

* * * * *